US010556443B2

(12) United States Patent
Katagami et al.

(10) Patent No.: US 10,556,443 B2
(45) Date of Patent: Feb. 11, 2020

(54) PRINTING APPARATUS

(71) Applicant: Seiko Epson Corporation, Tokyo (JP)

(72) Inventors: Satoru Katagami, Matsumoto (JP); Kazuyoshi Tanase, Matsumoto (JP); Tsutomu Sasaki, Matsumoto (JP); Yuichi Washio, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/083,336

(22) PCT Filed: Feb. 22, 2017

(86) PCT No.: PCT/JP2017/006631

§ 371 (c)(1),
(2) Date: Sep. 7, 2018

(87) PCT Pub. No.: WO2017/154580

PCT Pub. Date: Sep. 14, 2017

(65) Prior Publication Data

US 2019/0084329 A1 Mar. 21, 2019

(30) Foreign Application Priority Data

Mar. 9, 2016 (JP) ..... 2016-045292

(51) Int. Cl.
*B41J 2/21* (2006.01)
*B41J 2/15* (2006.01)
(Continued)

(52) U.S. Cl.
CPC ..... *B41J 2/2114* (2013.01); *B41J 2/15* (2013.01); *B41J 11/0015* (2013.01); *B41M 5/0017* (2013.01)

(58) Field of Classification Search
CPC ..... B41J 2/2114
See application file for complete search history.

(56) References Cited

U.S. PATENT DOCUMENTS 6,089,697 A * 7/2000 Tajika ..... B41J 2/14056 347/43
6,099,116 A * 8/2000 Fujita ..... B41J 2/2114 347/101
(Continued)

FOREIGN PATENT DOCUMENTS

CN 1519117 A 8/2004
JP 11-268260 5/1999
(Continued)

OTHER PUBLICATIONS

International Search Report cited in PCT/JP2017/00663 dated May 9, 2017, 2 pages.

*Primary Examiner* — Shelby L Fidler
(74) *Attorney, Agent, or Firm* — Workman Nydegger

(57) ABSTRACT

A printing apparatus includes a recording section including a plurality of ink heads configured to discharge, ink, a first reaction solution head, and a second reaction solution head configured to discharge the reaction solution, a driving section configured to drive the recording section, and a controller configured to execute causing the driving section to move the recording section in a first direction, causing the plurality of ink heads to discharge the ink, and causing the first reaction solution head and the second reaction solution head to discharge the reaction solution. The plurality of ink heads are arranged in the first direction. The first reaction solution head is located downstream in the first direction of an ink head located most downstream in the first direction. The second reaction solution head is located between two ink heads located adjacent to each other in the first direction.

13 Claims, 13 Drawing Sheets

(51) Int. Cl.
*B41J 11/00* (2006.01)
*B41M 5/00* (2006.01)

(56) References Cited

U.S. PATENT DOCUMENTS

| | | | | |
|---|---|---|---|---|
| 2004/0212667 | A1 | 10/2004 | Nishiguchi | |
| 2006/0071991 | A1* | 4/2006 | Yamanobe | B41J 2/114 347/95 |
| 2006/0197802 | A1 | 9/2006 | Konno | |
| 2007/0024648 | A1* | 2/2007 | Hirakawa | B41J 2/2114 347/6 |
| 2013/0050322 | A1 | 2/2013 | Vall | |
| 2014/0071465 | A1 | 3/2014 | Fernandez Del Rio | |

FOREIGN PATENT DOCUMENTS

| | | | |
|---|---|---|---|
| JP | 2001-001509 | A | 1/2001 |
| JP | 2002-036519 | A | 2/2002 |
| JP | 2003-326828 | A | 11/2003 |
| JP | 2006-240094 | A | 9/2006 |
| JP | 2007-253407 | A | 10/2007 |
| JP | 2011-121315 | A | 6/2011 |
| JP | 2014-210376 | A | 11/2014 |
| JP | 2014-240464 | A | 12/2014 |
| JP | 2015-116797 | A | 6/2015 |

* cited by examiner

PRINTING APPARATUS

TECHNICAL FIELD

The present invention relates to a technique of printing an image by applying a reaction solution onto a recording medium, and then applying ink containing a color material condensing with the reaction solution onto the recording medium.

BACKGROUND ART

In the related art, there is known a printing apparatus configured to cause a carriage and recording heads mounted on the carriage to move, and cause the recording heads to discharge ink onto a recording medium to print an image on the recording medium. Furthermore, in PTL 1, recording heads (ink heads) configured to discharge ink, and recording heads (reaction solution heads) configured to discharge reaction solutions are mounted on a carriage. The reaction solution heads are disposed downstream of the ink heads in a carriage movement direction. Before the ink heads discharge the ink, the reaction solution heads discharge the reaction solutions onto a recording medium in advance. Accordingly, a color material in the ink discharged from each of the ink heads onto the recording medium can condense with the reaction solution, and can be fixed onto the recording medium.

CITATION LIST

Patent Literature

PTL 1: JP-A-11-268260

SUMMARY OF INVENTION

Technical Problem

Furthermore, a printing apparatus can use a plurality of ink heads to print an image. In such a printing apparatus, the plurality of ink heads are arranged upstream of reaction solution heads in a movement direction relative to a recording medium. While the reaction solution heads and each of the ink heads move relative to the recording medium, the reaction solution heads and each of the ink heads discharge the reaction solutions and the ink, respectively. Accordingly, the plurality of ink heads sequentially discharge the ink in the range of the reaction solutions discharged by the reaction solution heads. In this case, elapsed time from the discharge of the reaction solution by each of the reaction solution heads to the discharge of the ink by each of the ink heads differs depending on positions of the ink heads. On the other hand, an amount of the reaction solution remaining on the recording medium reduces over time. For this reason, when the ink heads located away from the reaction solution heads discharge the ink, there has been a risk of deficiency in an amount of the reaction solution remaining on the recording medium and thus insufficient condensation of the color material in the ink.

In view of the above-described issues, an advantage of the present invention is to provide a technique of enabling, in a printing apparatus configured to use a plurality of ink heads to print an image, prevention of deficiency in an amount of a reaction solution on a recording medium when each of the ink heads discharge ink.

Solution to Problem

The present invention is made to address at least some of the above-described issues, and can be realized as the following aspects.

A printing apparatus according to the present invention includes a recording section including a plurality of ink heads configured to discharge, onto a medium, ink containing a color material condensing with a reaction solution, a first reaction solution head configured to discharge the reaction solution onto the recording medium, and a second reaction solution head configured to discharge the reaction solution onto the recording medium, a driving section configured to drive the recording section relative to the recording medium, and a controller configured to execute a first operation of causing the driving section to move the recording section in a first direction relative to the recording medium, causing the plurality of ink heads to discharge the ink, and causing the first reaction solution head and the second reaction solution head to discharge the reaction solutions. The plurality of ink heads are arranged in the first direction. The first reaction solution head is located downstream in the first direction of an ink head of the plurality of ink heads located most downstream in the first direction. The second reaction solution head is located between two ink heads of the plurality of ink heads located adjacent to each other in the first direction.

As described above, in the present invention (printing apparatus), the plurality of ink heads and the first and second reaction solution heads move in the first direction relative to the recording medium, and discharge the ink and the reaction solutions, respectively onto the recording medium (first operation). In this case, the plurality of ink heads are arranged in the first direction, and the first reaction solution head is located downstream in the first direction of the plurality of ink heads. Therefore, in the first operation, the plurality of ink heads sequentially discharge the ink in the range of the reaction solution discharged by the first reaction solution head located at a top in the first direction. Then, in the present invention, to address a reduction in a remaining amount of the reaction solution on the recording medium during execution of the first operation, the second reaction solution head is provided between the two ink heads adjacent to each other. Accordingly, after the first reaction solution head has discharged the reaction solution, the second reaction solution head can additionally discharge the reaction solution onto the recording medium to supplement an amount of the reaction solution on the recording medium. As a result, the amount of the reaction solution on the recording medium can be prevented from being deficient when each of the ink heads discharge the ink.

Furthermore, the printing apparatus may include a configuration where, in the first operation, an amount of the reaction solution to be discharged per unit area by the second reaction solution head onto the recording medium is smaller than an amount of the reaction solution to be discharged per unit area by the first reaction solution head onto the recording medium. Accordingly, even when the second reaction solution head adds the reaction solution, an excess of the reaction solution on the recording medium can be prevented.

Furthermore, the printing apparatus may include a configuration where at least two ink heads of the plurality of ink heads are located between the first reaction solution head and the second reaction solution head. In such a configuration, the reaction solution can be added by the second reaction solution head at timing when certain time has passed after the discharge of the reaction solution by the first reaction solution head, and when an amount of the reaction solution remaining on the recording medium is reduced.

Furthermore, the printing apparatus may include a configuration where the number of the ink heads located upstream in the first direction of the second reaction solution head is equal to or less than the number of the ink heads located downstream in the first direction of the second reaction solution head. In such a configuration, the reaction solution can be added by the second reaction solution head at timing when certain time has passed after the discharge of the reaction solution by the first reaction solution head, and when an amount of the reaction solution remaining on the recording medium is reduced.

Furthermore, the printing apparatus may include a configuration where an ink head of the plurality of ink heads configured to discharge black ink is located upstream in the first direction of the second reaction solution head. In such a configuration, the black ink is discharged onto the recording medium supplemented with the reaction solution by the second reaction solution head, and thus, a black color material can be fixed securely onto the recording medium.

Furthermore, the printing apparatus may include a configuration where, as compared with the reaction solution to be discharged by the first reaction solution head, the second reaction solution head discharges the reaction solution appropriate for ink to be discharged by an ink head of the plurality of ink heads located upstream in the first direction of the second reaction solution head. In such a configuration, a color material in the ink discharged from the ink head after the discharge of the reaction solution by the second reaction solution head can be fixed securely onto the recording medium.

Furthermore, the printing apparatus may include a configuration where the recording section includes a third reaction solution head being located downstream in a second direction opposite to the first direction of an ink head of the plurality of ink heads located most downstream in the second direction, and being configured to discharge the reaction solution onto the recording medium, and where the controller is configured to execute a second operation of causing the driving section to move the recording section in the second direction relative to the recording medium, causing the plurality of ink heads to discharge the ink, and causing the third reaction solution head and the second reaction solution head to discharge the reaction solutions.

In such a configuration, in the second operation, the plurality of ink heads sequentially discharge the ink in the range of the reaction solution discharged by the third reaction solution head located at a top in the second direction. In this case, since the second reaction solution head is provided, a reduction in a remaining amount of the reaction solution on the recording medium during execution of the second operation can be addressed. That is, after the third reaction solution head has discharged the reaction solution, the second reaction solution head can additionally discharge the reaction solution onto the recording medium to supplement an amount of the reaction solution on the recording medium. As a result, the amount of the reaction solution on the recording medium can be prevented from being deficient when each of the ink heads discharge the ink.

Furthermore, the printing apparatus may include a configuration where the recording section includes a fourth reaction solution head located between two ink heads of the plurality of ink heads located upstream in the second direction of the second reaction solution head, and the controller causes the fourth reaction solution head to discharge the reaction solution in the first operation and the second operation. In such a configuration, in each of the first and second operations, the reaction solution can be added onto the recording medium by each of the second and fourth reaction solution heads, and an amount of the reaction solution on the recording medium can be prevented further securely from being deficient when each of the ink heads discharge the ink.

Furthermore, the printing apparatus may include a configuration where, in the first operation, an amount of the reaction solution to be discharged per unit area by the fourth reaction solution head onto the recording medium is smaller than the amount of the reaction solution to be discharged per unit area by the first reaction solution head onto the recording medium, and the amount of the reaction solution to be discharged per unit area by the second reaction solution head onto the recording medium is smaller than the amount of the reaction solution to be discharged per unit area by the fourth reaction solution head onto the recording medium, and where, in the second operation, an amount of the reaction solution to be discharged per unit area by the second reaction solution head onto the recording medium is smaller than an amount of the reaction solution to be discharged per unit area by the third reaction solution head onto the recording medium, and an amount of the reaction solution to be discharged per unit area by the fourth reaction solution head onto the recording medium is smaller than the amount of the reaction solution to be discharged per unit area by the second reaction solution head onto the recording medium. Accordingly, even when the second and fourth reaction solution heads add the reaction solutions in each of the first and second operations, an excess of the reaction solution on the recording medium can be prevented.

Furthermore, the printing apparatus may include a configuration where the amount of the reaction solution to be discharged per unit area by the second reaction solution head onto the recording medium in the first operation is smaller than the amount of the reaction solution to be discharged per unit area by the second reaction solution head onto the recording medium in the second operation, and the amount of the reaction solution to be discharged per unit area by the fourth reaction solution head onto the recording medium in the second operation is smaller than the amount of the reaction solution to be discharged per unit area by the fourth reaction solution head onto the recording medium in the first operation. Accordingly, even when the second and fourth reaction solution heads add the reaction solutions in each of the first and second operations, an excess of the reaction solution on the recording medium can be prevented.

Furthermore, the printing apparatus may include a configuration where a landing position of the reaction solution discharged by the first reaction solution head onto the recording medium differs from a landing position of the reaction solution discharged by the second reaction solution head onto the recording medium. In such a configuration, the reaction solution can be discharged relatively evenly onto the recording medium.

Specifically, the printing apparatus may include a configuration where the first reaction solution head and the second reaction solution head are deviated from each other in a third direction intersecting the first direction, and a landing position of the reaction solution discharged by the first reaction solution head onto the recording medium differs in the third direction from a landing position of the reaction solution discharged by the second reaction solution head onto the recording medium. Alternatively, the printing apparatus may include a configuration where the controller controls timing when the first reaction solution head discharges the reaction solution and timing when the second reaction solution head discharges the reaction solution to cause the landing position of the reaction solution discharged by the first reaction solution head onto the recording medium to differ in the first direction from the landing position of the reaction solution discharged by the second reaction solution head onto the recording medium.

DESCRIPTION OF EMBODIMENTS

Figure 1:
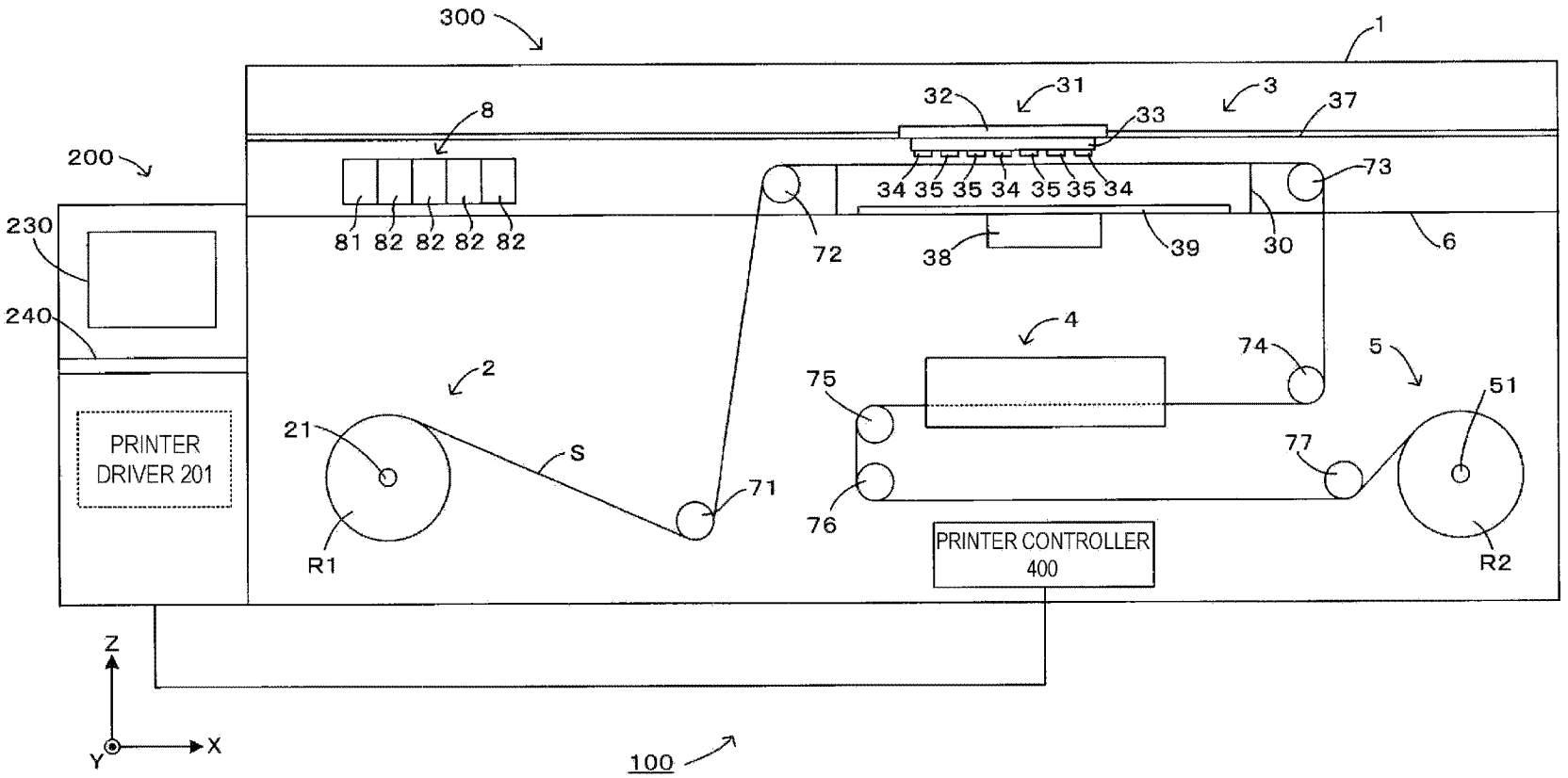
FIG. 1 is a front view illustrating a printing system including a printer to which the present invention is applied.

FIG. 1 is a front view schematically illustrating an example of a printing system including a printer to which the present invention is applied. Note that in FIG. 1 and the following drawings, XYZ orthogonal coordinates are provided as appropriate for clarity of arrangement relationships of device components, and in the XYZ orthogonal coordinates, a Z-axis is designated as a vertical axis. Furthermore, in the following description, a direction in which each coordinate axis (arrow) orients will be referred to as a positive direction, and a direction opposite to the positive direction will be referred to as a negative direction as appropriate.

A printing system 100 includes a host device 200 configured to generate print data from image data (bit map data) received from an external device such as a personal computer, and a printer 300 configured to print an image based on the print data received from the host device 200. The printer 300 transports a long sheet S in a roll-to-roll manner, and prints an image on a surface of the sheet S by using an ink jet method.

As illustrated in FIG. 1, the printer 300 includes a main body case 1 having a substantially rectangular parallelepiped shape. A feeding section 2 configured to feed the sheet S from a roll R1 formed by winding the sheet S, a printing chamber 3 configured to discharge ink onto the surface of the sheet S fed to perform printing, a drying section 4 configured to dry the sheet S to which the ink has adhered, and a winding section 5 configured to wind the sheet S dried as a roll R2 are disposed inside the main body case 1.

More specifically, the inside of the main body case 1 is vertically partitioned in a Z-axis direction by a base 6 having a flat plate shape and disposed parallel (that is, horizontally) to an XY plane. The printing chamber 3 is defined above the base 6. At an approximately center section inside the printing chamber 3, a platen 30 is fixed on an upper face of the base 6. The platen 30 has a rectangular shape and includes an upper face parallel to the XY plane to support the sheet S from below. Then, a recording unit 31 performs printing on the surface of the sheet S supported on the platen 30.

On the other hand, the feeding section 2, the drying section 4, and the winding section 5 are disposed below the base 6. The feeding section 2 is disposed below in the X-axis negative direction (diagonally left downward in FIG. 1) with respect to the platen 30, and includes a feeding shaft 21 that is rotatable. Then, the sheet S is wound around the feeding shaft 21, and thus, the roll R1 is supported. On the other hand, the winding section 5 is disposed below in the X-axis positive direction (diagonally right downward in FIG. 1) with respect to the platen 30, and includes a winding shaft 51 that is rotatable. Then, the sheet S is wound onto the winding shaft 51, and thus, the roll R2 is supported. Furthermore, the drying section 4 is disposed between the feeding section 2 and the winding section 5 in an X-axis direction, and immediately below the platen 30.

Then, the sheet S fed from the feeding shaft 21 of the feeding section 2 is guided by rollers 71 to 77 to sequentially pass through the printing chamber 3 and the drying section 4, and then is wound onto the winding shaft 51 of the winding section 5. Note that the rollers 72 and 73 are disposed to be arranged in a straight line in the X-axis direction (that is, horizontally) with the platen 30 interposed between the rollers 72 and 73, and a top of each of the rollers 72 and 73 is adjusted to be positioned at an identical height to the upper face (face supporting the sheet S) of the platen 30. Therefore, the sheet S wound on the roller 72 slides onto the upper face of the platen 30 and moves horizontally (X-axis direction) to the roller 73.

In the printing chamber 3, the recording unit 31 disposed above the platen 30 executes a printing process on the sheet S. The recording unit 31 discharges a reaction solution onto the surface of the sheet S, and then discharges ink onto the surface of the sheet S to print an image on the surface of the sheet S. That is, an end portion (left end portion in FIG. 1) in the X-axis negative direction inside the printing chamber 3 is provided with a cartridge attaching section 8. A reaction solution cartridge 81 configured to store the reaction solution, and a plurality of ink cartridges 82 configured to respectively store the ink of different colors are detachably attached to the cartridge attaching section 8. Accordingly, the recording unit 31 is capable of discharging the reaction solution supplied from the reaction solution cartridge 81, and the ink supplied from the ink cartridges 82 onto the surface of the sheet S by the ink jet method.

Note that the reaction solution includes a flocculant dissolved in a solvent, and the flocculant causes a color material in the ink to condense. As the flocculant, a multivalent metal salt can be used advantageously. As the multivalent metal salt, for example, one or more of calcium nitrate, calcium chloride, magnesium chloride, calcium acetate, magnesium acetate, and calcium formate can be used advantageously. Furthermore, as the solvent of the reaction solution, water is advantageously used. In addition to water, a water miscible organic solvent such as polyalcohols and polyalcohol derivatives may be added.

Figure 2:
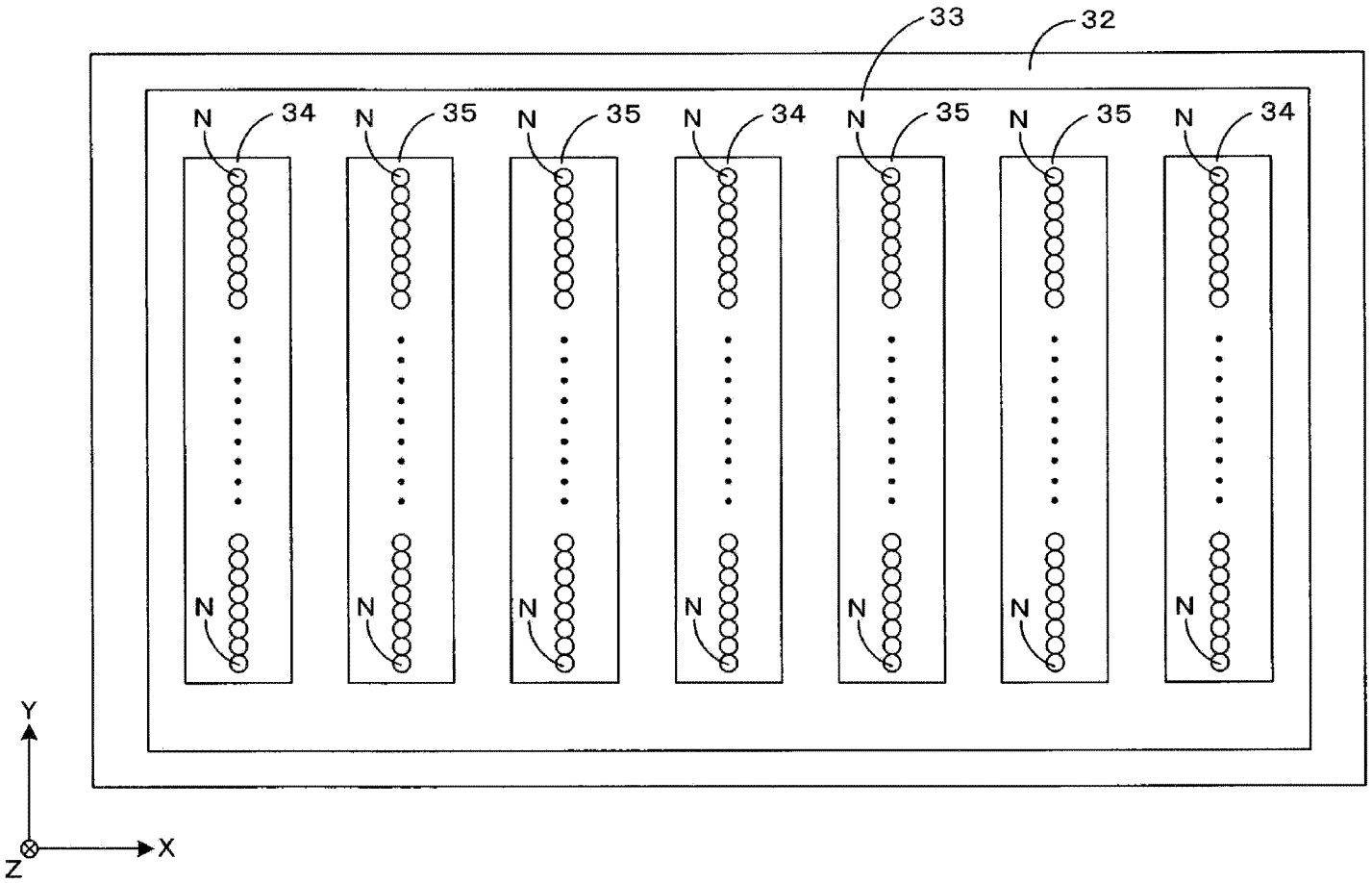
FIG. 2 is a bottom view partially illustrating a configuration of a recording unit.

FIG. 2 is a bottom view partially illustrating a configuration of the recording unit. Here, the recording unit 31 will be described in detail with reference to FIGS. 1 and 2. The recording unit 31 includes a carriage 32, a support plate 33 having a flat plate shape and attached to a lower face of the carriage 32, and recording heads 34 and 35 attached to a lower face of the support plate 33. On the lower face of the support plate 33, one recording head 34, two recording heads 35, one recording head 34, two recording heads 35, and one recording head 34 are arranged at an equal pitch in the X-axis direction. That is, the recording unit 31 includes four recording heads 35 arranged in the X-axis direction, two recording heads 34 respectively disposed on both sides of the four recording heads 35, and one recording head 34 disposed between two recording heads 35 located at the center of the four recording heads 35. On each of the recording heads 34 and 35, a plurality of nozzles N are arranged parallel in a Y-axis direction. Then, each of the three recording heads 34 discharge the reaction solution from the nozzles N. The four recording heads 35 discharge the ink of different colors, respectively from the nozzles N.

Again, with reference to FIG. 1, the description is continued. The recording unit 31 and the carriage 32 configured as described above are capable of integrally moving with the support plate 33 and the recording heads 34 and 35. That is, an X-axis guide rail 37 extending parallel in the X-axis direction is provided inside the printing chamber 3. When the carriage 32 receives driving force of an X-axis motor Mx (FIG. 3), the carriage 32 moves in the X-axis direction along the X-axis guide rail 37. Further, a Y-axis guide rail (not illustrated) extending in the Y-axis direction is provided inside the printing chamber 3. When the carriage 32 receives driving force of a Y-axis motor My (FIG. 3), the carriage 32 moves in the Y-axis direction along the Y-axis guide rail.

Then, printing is executed by a lateral scanning method described in, for example, JP-A-2013-000997. According to the method, printing is executed by moving the carriage 32 of the recording unit 31 in the XY plane in a two dimensional manner with respect to the sheet S stationary on the upper face of the platen 30. Specifically, the recording unit 31 executes an operation (main scanning) of causing the carriage 32 to move in the X-axis direction (main scanning direction), and causing each of the nozzles N of the recording heads 35 to discharge the ink onto the surface of the sheet S. In the main scanning, an image of one line (line image) extending in the X-axis direction is formed with the ink discharged by one of the nozzles N, and a plurality of the line images are arranged in the Y-axis direction at an interval to result in a two dimensional image printed. Then, the main scanning, and sub scanning of causing the carriage 32 to move in the Y-axis direction (sub scanning direction) are alternately executed to execute the main scanning a plurality of times.

That is, after the recording unit 31 completes the main scanning once, the recording unit 31 performs the sub scanning to cause the carriage 32 to move in the Y-axis direction. Subsequently, the recording unit 31 causes the carriage 32 to move in the X-axis direction (direction opposite to the direction of the previous main scanning) from a position to which the carriage 32 has moved in the sub scanning. Accordingly, a line image is formed in the next main scanning among the respective plurality of line images having already formed in the previous main scanning. Then, the printer 300 alternately executes the main scanning and the sub scanning, and thus, the printer 300 causes the carriage 32 to move back and forth to execute the main scanning a plurality of times, and prints an image of one frame.

In particular, in the main scanning according to the exemplary embodiment, the reaction solution is discharged from one of the two recording heads 34, and the one recording head 34. The one of the two recording heads 34 is at a top in one of movement directions of the carriage 32. The one recording head 34 is at the center. That is, during execution of the main scanning, each of the recording heads 34 discharges the reaction solution in the range of the ink to be discharged by each of the recording heads 35 located upstream in each of the movement directions. Therefore, the color material in the ink in each line image printed in the main scanning condenses by action of the reaction solution discharged in advance onto the surface of the sheet S, and is fixed onto the surface of the sheet S.

While the sheet S is caused to intermittently move in the X-axis direction, the printing of one frame as described above is repeatedly executed. Specifically, a specific range extending almost throughout the upper face of the platen 30 serves as a printing region. Then, assuming a distance corresponding to a length in the X-axis direction of the printing region (distance of intermittent transport) as a unit, the sheet S is intermittently transported in the X-axis direction, and printing of one frame is executed on the sheet S stationary on the upper face of the platen 30 during the intermittent transport. In other words, after the printing of one frame ends on the sheet S stationary on the platen 30, the sheet S is transported in the X-axis direction by the distance of intermittent transport to cause an unprinted surface of the sheet S to be stationary on the platen 30. Subsequently, the printing of one frame is newly executed on the unprinted surface. After the printing is completed, the sheet S is again transported in the X-axis direction by the distance of intermittent transport. Then, a series of these operations are repeatedly executed.

Note that to keep leveling the sheet S stationary on the upper face of the platen 30 during the intermittent transport, the platen 30 includes a mechanism configured to suck the sheet S stationary onto the upper face of the platen 30. Specifically, a plurality of suction holes (not illustrated) are open on the upper face of the platen 30, and a suction section 38 is attached to a lower face of the platen 30. Then, the suction section 38 operates, and thus, negative pressure occurs in the suction holes on the upper face of the platen 30 to suck the sheet S onto the upper face of the platen 30. Then, while the sheet S is stationary on the platen 30 for printing, the suction section 38 sucks the sheet S to keep leveling the sheet S. On the other hand, after the printing ends, the suction section 38 stops sucking the sheet S, and thus, the sheet S can be transported smoothly.

Further, a heater 39 is attached to the lower face of the platen 30. The heater 39 is configured to heat the platen 30 at a specific temperature (for example, 45° C). Accordingly, the sheet S is subjected to the printing process by the recording heads 34 and 35, and is also subjected to primary drying by heat of the platen 30. Then, the primary drying facilitates drying of the reaction solution and the ink having landed on the sheet S.

Accordingly, the sheet S subjected to the printing of one frame and to the primary drying is intermittently transported to move from the platen 30 to the drying section 4. The drying section 4 executes a drying process of fully drying the reaction solution and the ink having landed on the sheet S by air heated for drying. Then, after the sheet S subjected to the drying process is intermittently transported to reach the winding section 5, and is wound as the roll R2 onto the winding section 5.

Figure 3:
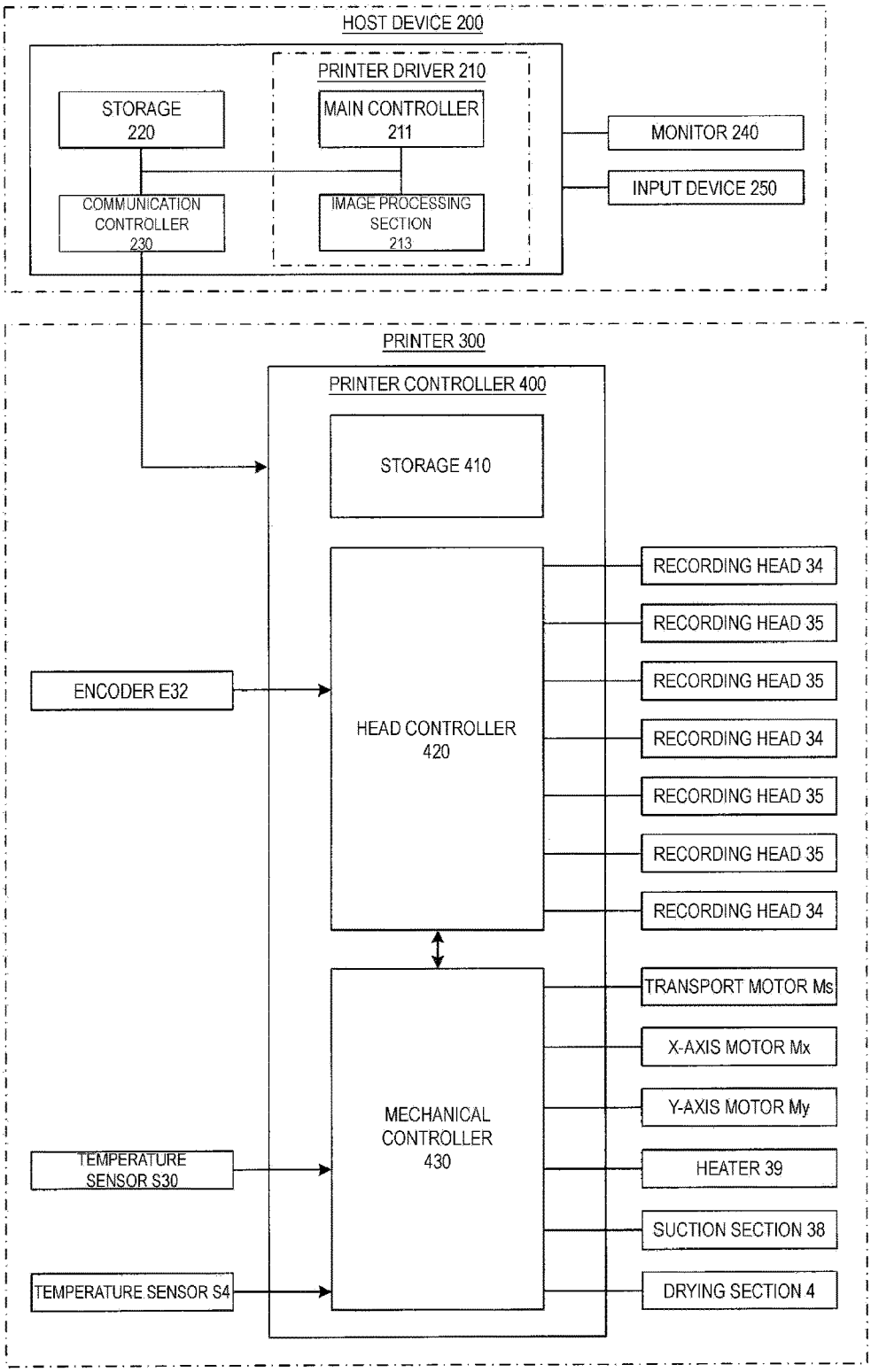
FIG. 3 is a block diagram schematically illustrating an electrical configuration of the printing system in FIG. 1.

The outline of the mechanical configuration of the printing system 100 has been described above. Subsequently, an electrical configuration of the printing system 100 in FIG. 1 described above will be described in detail with reference to FIG. 3 in addition to FIG. 1. Here, FIG. 3 is a block diagram schematically illustrating the electrical configuration of the printing apparatus in FIG. 1.

As described above, the printing system 100 includes the host device 200 configured to control the printer 300. The host device 200 includes a personal computer, for example, and includes a printer driver 210 configured to control an operation of the printer 300. Note that the printer driver 210 is realized by causing a Central Processing Unit (CPU) of the host device 200 to execute a program for the printer driver 210. Further, the host device 200 includes a storage 220 including a Random Access Memory (RAM), a Hard Disk Drive (HDD), and the like, and a communication controller 230 configured for a communication function with the printer 300.

Furthermore, as an interface with an operator, the host device 200 includes a monitor 240 including a liquid crystal display, and the like, and an input device 250 including a keyboard, a mouse, and the like. Note that the monitor 240 and the input device 250 may be constituted integrally into a touch panel display. The monitor 240 displays an image to be printed and a menu screen. Therefore, an operator views the monitor 240, and operates the input device 250 to open a print setting screen from the menu screen, and can set various printing conditions including a type of the sheet S, a size of the sheet S, print quality, the number of sheets, and the like.

The printer driver 210 includes a main controller 211. The main controller 211 is configured to control displaying on the monitor 240 and processes of inputting through the input device 250. Specifically, the main controller 211 causes the monitor 240 to display various screens including the menu screen, the print setting screen, and the like, and the main controller 211 performs processes according to contents input through the input device 250 on the various screens. Accordingly, the main controller 211 generates a control signal used to control the printer 300 in accordance with an input by an operator.

Further, the printer driver 210 includes an image processing section 213 configured to execute an imaging process on image data received from an external device. The image processing section 213 generates print data used to drive the recording heads 35 in accordance with the image data. Specifically, the image processing section 213 executes a color conversion process and a halftone process on the image data. That is, the image data received from the external device includes three color components of red, green, and blue. A pixel value of each pixel is represented with multi gradations (for example, 256 gradations). Thus, the image processing section 213 executes the color conversion process on the image data. In the color conversion process, the color components of red, green, and blue are converted into a plurality of color components (for example, yellow, magenta, cyan, and black) printable with the printer 300. Then, the image processing section 213 executes the halftone process using a dither matrix on the image data subjected to the color conversion process. In the halftone process, image data including a pixel value of each pixel represented with multi gradations is converted into print data corresponding to binary data indicative of presence and absence of discharge of an ink dot to each pixel.

Communication Controller 230

Then, the control signal generated by the main controller 211 and the print data generated by the image processing section 213 are forwarded via the communication controller 230 to a printer controller 400 provided in the main body case 1 of the printer 300. The communication controller 230 is configured to be capable of bidirectional serial communication with the printer controller 400 to forward the control signal and the print data to the printer controller 400, and also to receive a response signal from the printer controller 400 to send the received response signal to the main controller 211.

The printer controller 400 includes a storage 410, a head controller 420, and a mechanical controller 430. The storage 410 includes an HDD, and the like, and is configured to store a program used to execute the printing process, and to store the control signal and the print data sent from the host device 200.

The head controller 420 is configured to control the recording heads 34 and 35 based on the control signal and the print data sent from the printer driver 210. Specifically, the head controller 420 controls an amount of the reaction solution to be discharged per unit area from each of the recording heads 34 onto the sheet S, that is, controls a duty to cause an appropriate amount of the reaction solution to land at a specific position on the sheet S. Furthermore, the head controller 420 controls discharge of the ink from the recording heads 35 based on the print data to cause the ink to land at a position indicated in the print data.

In this case, timing of discharge from the recording heads 34 and 35 is controlled based on movement in the X-axis direction of the carriage 32. That is, a linear encoder E32 configured to detect a position in the X-axis direction of the carriage 32 is provided inside the printing chamber 3. Then, the head controller 420 refers to an output of the linear encoder E32 to cause the recording heads 34 and 35 to discharge the reaction solutions and the ink at timing according to movement in the X-axis direction of the carriage 32.

On the other hand, the mechanical controller 430 is configured to mainly control the intermittent transport of the sheet S and the driving of the carriage 32. Specifically, the mechanical controller 430 controls a transport motor Ms configured to drive a sheet transport system including the feeding section 2, the rollers 71 to 77, and the winding section 5 to execute the intermittent transport of the sheet S. Furthermore, the mechanical controller 430 controls the X-axis motor Mx to cause the carriage 32 to move in the X-axis direction for the main scanning, and controls the Y-axis motor My to cause the carriage 32 to move in the Y-axis direction for the sub scanning.

Further, the mechanical controller 430 is capable of executing various types of control in addition to the above-described control for the printing process. For example, the mechanical controller 430 executes temperature control including feedback control on the heater 39 based on an output of a temperature sensor S30 configured to detect a temperature of the upper face of the platen 30, and feedback control on the drying section 4 based on an output of a temperature sensor S4 configured to detect a temperature inside the drying section 4.

The outline of the electrical configuration of the printing system in FIG. 1 has been described above. As described above, in the printing process executed by the printer 300, the reaction solution is discharged from each of the recording heads 34 onto the surface of the sheet S, and then the ink is discharged from each of the recording heads 35 onto the surface of the sheet S, and thus, the color material in the ink condenses due to action of the reaction solution to be fixed onto the surface of the sheet S. In such a printing process, time lag occurs after the reaction solution lands in a certain range of the sheet S until the ink lands in such a range. Then, during the time lag, the reaction solution having landed on the surface of the sheet S penetrates the sheet S. In this case, the printing process is to be controlled to cause a sufficient amount of the reaction solution to remain on the surface of the sheet S when the ink is discharged onto the surface of the sheet S. Such an operation will be described below.

FIGS. 4, 5, 6, and 7 are views each schematically illustrating an operation executed in the printing process according to the first exemplary embodiment. Here, recording heads 34*a* to 34*c* are illustrated to distinguish the three recording heads 34 for reaction solution, and recording heads 35*a* to 35*d* are illustrated to distinguish the four recording heads 35 for ink. As described above, in the printing process, the recording unit 31 moves back and forth in the X-axis direction (main scanning direction) to execute the main scanning in each of an outward path and a return path. With respect to this, FIGS. 4 and 5 each illustrate an outward printing operation of causing the recording unit 31 to move in an outward direction Dv1 at a speed V and to execute the main scanning, and FIGS. 6 and 7 each illustrate a return printing operation of causing the recording unit 31 to move in a return direction Dv2 opposite to the outward direction Dv1 at the speed V and to execute the main scanning.

Figure 4:
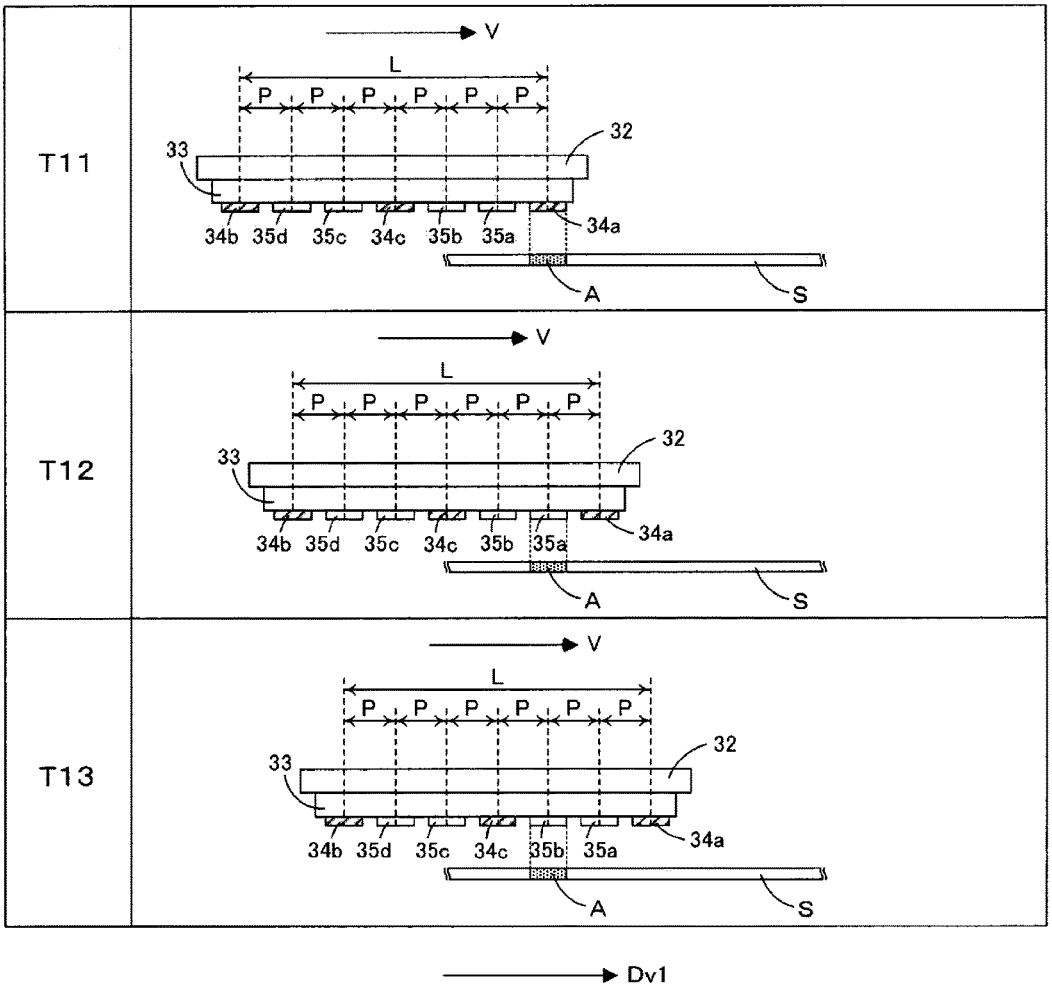
FIG. 4 is a view illustrating an operation executed in a printing process according to a first exemplary embodiment.
Figure 5:
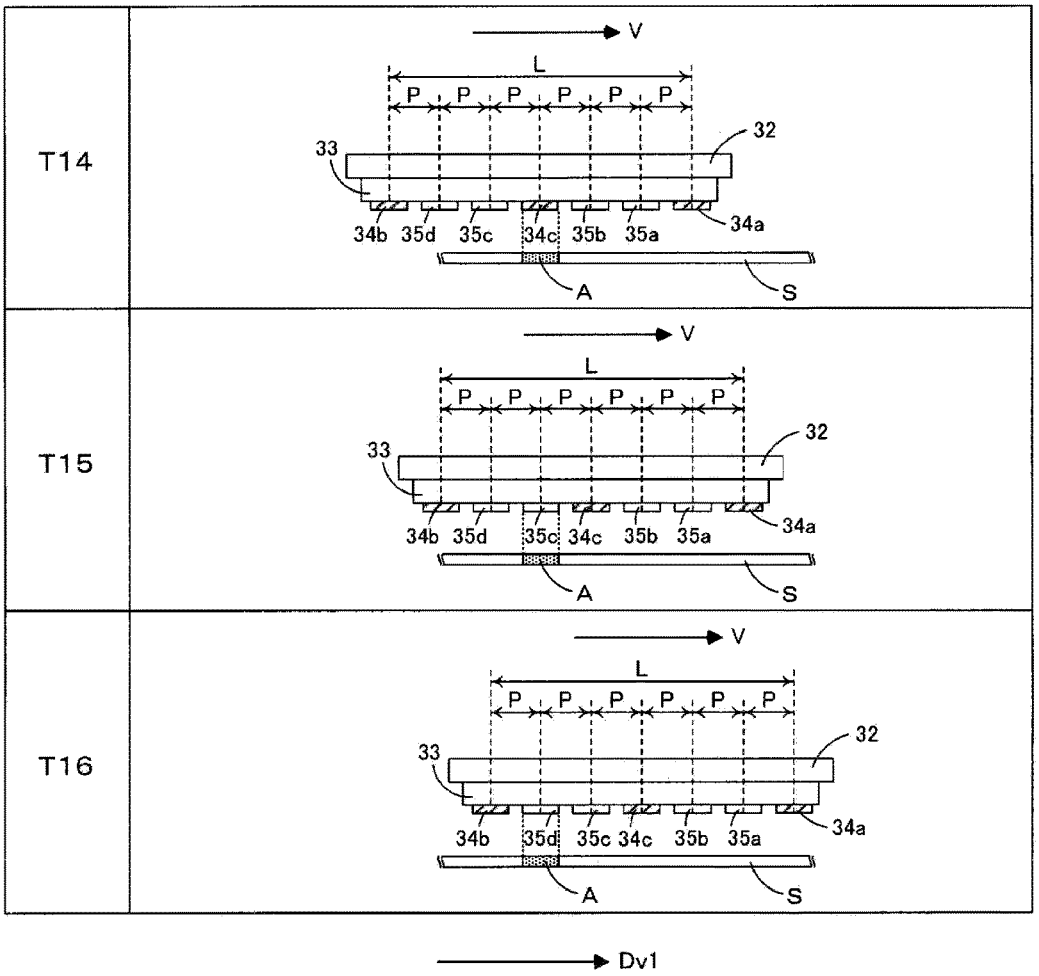
FIG. 5 is a view illustrating an operation executed in the printing process according to the first exemplary embodiment.

As illustrated in FIGS. 4 and 5, the recording heads 34*a*, 34*c*, and 34*b* are arranged in this order from downstream in the outward direction Dv1. Then, between the two recording heads 34*a* and 34*c*, the two recording heads 35*a* and 35*b* are arranged in this order from downstream in the outward direction Dv1. Between the two recording heads 34*c* and 34*b*, the two recording heads 35*c* and 35*d* are arranged in this order from downstream in the outward direction Dv1. Accordingly, the recording heads 34*a*, 35*a*, 35*b*, 34*c*, 35*c*, 35*d*, and 34*b* are arranged in this order from downstream in the outward direction Dv1 at an equal pitch P along the outward direction Dv1. Then, in the outward printing operation, each of the recording heads 35*a* to 35*d* discharge the ink, while the recording head 34*a* disposed downstream in the outward direction Dv1 of the recording head 35*a* located most downstream of the recording heads 35*a* to 35*d*, and the recording head 34*c* disposed between the two recording heads 35*b* and 35*c* adjacent to each other discharge the reaction solutions.

In particular, here, an example where the reaction solutions and the ink are discharged in a specific range A of the sheet S will be described. At time T11, the recording head 34*a* at a top (most downstream) in the outward direction Dv1 reaches immediately above the range A, and discharges the reaction solution in the range A. Subsequently, the two recording heads 35*a* and 35*b* of the recording heads 35*a* to 35*d* disposed between the two recording heads 34*a* and 34*c* reach in this order immediately above the range A, and each discharge the ink in the range A (time T12 and T13). Accordingly, the color material in the ink discharged from each of the recording heads 35*a* and 35*b* condense with the reaction solution discharged from the recording head 34*a* onto the sheet S.

In this case, the reaction solution applied onto the surface of the sheet S at time T11 penetrates the sheet S over time, and thus, an amount of the reaction solution remaining on the surface of the sheet S reduces over time from time T11 to time T13. To address such a reduction in an amount of the reaction solution, at time T14, the recording head 34*c* reaches immediately above the range A, and discharges the reaction solution in the range A to supplement the reaction solution on the surface of the sheet S. Note that a duty of the reaction solution to be discharged by the recording head 34*c* at time T14 is lower than a duty of the reaction solution to be discharged by the recording head 34*a* at time T11. Subsequently, the two recording heads 35*c* and 35*d* of the recording heads 35*a* to 35*d* disposed between the two recording heads 34*c* and 34*b* reach in this order immediately above the range A, and each discharge the ink in the range A (time T15 and T16). Accordingly, the color material in the ink discharged from each of the recording heads 35*c* and 35*d* condenses with the reaction solution discharged from each of the recording heads 34*a* and 34*c* onto the sheet S.

Figure 6:
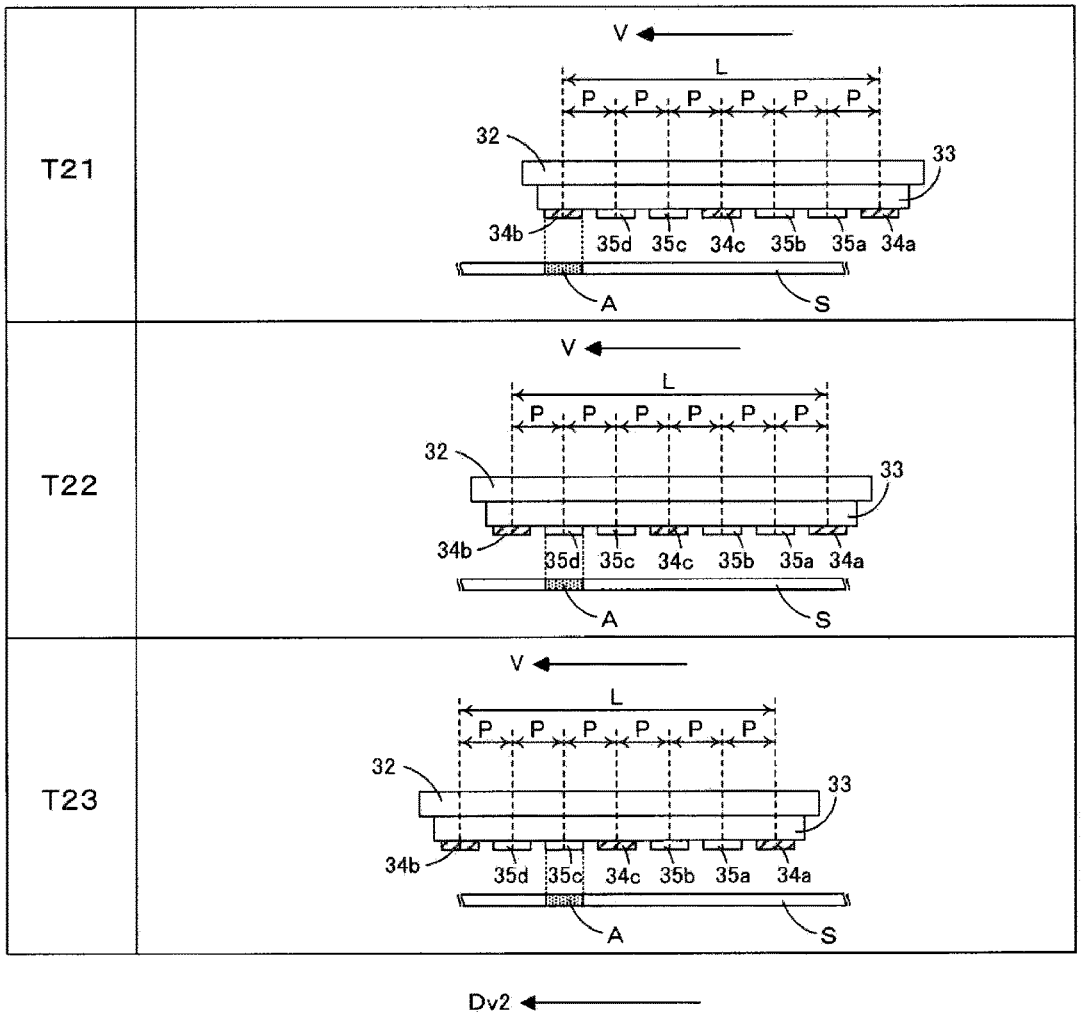
FIG. 6 is a view illustrating an operation executed in the printing process according to the first exemplary embodiment.
Figure 7:
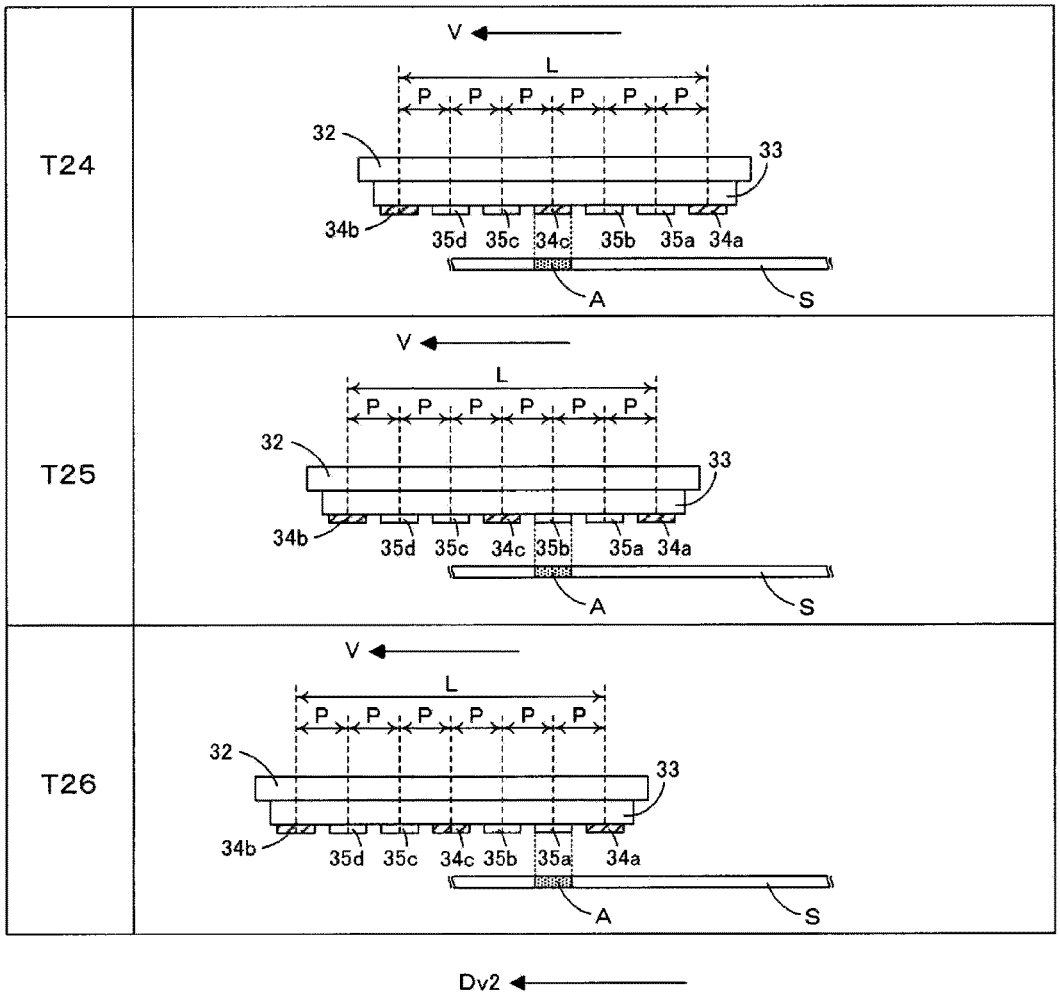
FIG. 7 is a view illustrating an operation executed in the printing process according to the first exemplary embodiment.

Accordingly, the outward printing operation is completed, and the return printing operation is subsequently executed in a similar manner. That is, as illustrated in FIGS. 6 and 7, the recording heads 34*b*, 35*d*, 35*c*, 34*c*, 35*b*, 35*a*, and 34*a* are arranged in this order from downstream in the return direction Dv2 at the equal pitch P in parallel to the return direction Dv2. Then, in the return printing operation, each of the recording heads 35*d* to 35*a* discharge the ink, while the recording head 34*b* disposed downstream in the return direction Dv2 of the recording head 35*d* located most downstream of the recording heads 35*d* to 35*a*, and the recording head 34*c* disposed between the two recording heads 35*c* and 35*b* adjacent to each other discharge the reaction solutions.

That is, at time T21, the recording head 34*b* at a top (most downstream) in the return direction Dv2 reaches immediately above the range A, and discharges the reaction solution in the range A. Subsequently, the two recording heads 35*d* and 35*c* of the recording heads 35*d* to 35*a* disposed between the two recording heads 34*b* and 34*c* reach in this order immediately above the range A, and each discharge the ink in the range A (time T22 and T23). Accordingly, the color material in the ink discharged from each of the recording heads 35*d* and 35*c* condenses with the reaction solution discharged from the recording head 34*b* onto the sheet S.

In this case, the reaction solution applied onto the surface of the sheet S at time T21 penetrates the sheet S over time, and thus, an amount of the reaction solution remaining on the surface of the sheet S reduces over time from time T21 to time T23. To address such a reduction in an amount of the reaction solution, at time T24, the recording head 34*c* reaches immediately above the range A, and discharges the reaction solution in the range A to supplement the reaction solution on the surface of the sheet S. Note that a duty of the reaction solution to be discharged by the recording head 34*c* at time T24 is lower than a duty of the reaction solution to be discharged by the recording head 34*b* at time T21. Subsequently, the two recording heads 35*b* and 35*a* of the recording heads 35*d* to 35*a* disposed between the two recording heads 34*c* and 34*a* reach in this order immediately above the range A, and each discharge the ink in the range A (time T25 and T26). Accordingly, the color material in the ink discharged from each of the recording heads 35*b* and 35*a* condenses with the reaction solution discharged from each of the recording heads 34*b* and 34*c* onto the sheet S. Accordingly, the return printing operation is completed.

As described above, in the exemplary embodiment, the four recording heads 35*a* to 35*d*, and the two recording heads 34*a* and 34*c* move in the outward direction Dv1 relative to the sheet S, and discharge the ink and the reaction solutions, respectively onto the sheet S (outward printing operation). In this case, the four recording heads 35*a* to 35*d* are arranged in the outward direction Dv1, and the recording head 34*a* is located downstream in the outward direction Dv1 of the recording heads 35*a* to 35*d*. Therefore, in the outward printing operation, the plurality of recording heads 35*a* to 35*d* sequentially discharge the ink in the range A of the reaction solution discharged by the recording head 34*a* located at the top in the outward direction Dv1. Then, in the exemplary embodiment, to address a reduction in a remaining amount of the reaction solution on the surface of the sheet S during execution of the outward printing operation, the recording head 34*c* is provided between the two recording heads 35*b* and 35*c*. Accordingly, after the recording head 34*a* has discharged the reaction solution, the recording head 34*c* can additionally discharge the reaction solution onto the sheet S to supplement an amount of the reaction solution on the surface of the sheet S. As a result, the amount of the reaction solution on the surface of the sheet S can be prevented from being deficient when each of the recording heads 35*a* to 35*d* discharge the ink.

Furthermore, the recording head 34*b* is disposed downstream in the return direction Dv2 of the four recording heads 35*a* to 35*d*. Then, the four recording heads 35*d* to 35*a*, and the two recording heads 34*b* and 34*c* move in the return direction Dv2 relative to the sheet S, and discharge the ink and the reaction solutions, respectively onto the sheet S (return printing operation). In such a configuration, in the return printing operation, the four recording heads 35*d* to 35*a* sequentially discharge the ink in the range A of the reaction solution discharged by the recording head 34*b* located at the top in the return direction Dv2. In this case, the recording head 34*c* is provided, and thus, a reduction in a remaining amount of the reaction solution on the surface of the sheet S during execution of the return printing operation can be addressed. That is, after the recording head 34*b* has discharged the reaction solution, the recording head 34*c* can additionally discharge the reaction solution onto the sheet S to supplement an amount of the reaction solution on the surface of the sheet S. As a result, the amount of the reaction solution on the surface of the sheet S can be prevented from being deficient when each of the recording heads 35*d* to 35*a* discharge the ink.

Furthermore, in each of the outward printing operation and the return printing operation, an amount of the reaction solution to be discharged per unit area by the recording head 34*c* onto the sheet S is smaller than an amount of the reaction solution to be discharged per unit area by each of the recording heads 34*a* and 34*b* onto the sheet S. Accordingly, even when the recording head 34*c* adds the reaction solution, an excess of the reaction solution on the recording medium can be prevented.

That is, when an excess amount of the reaction solution is present on the surface of the sheet S, a film of the reaction solution may be formed around an ink droplet having landed on the sheet S, and thus, the ink droplet may expand insufficiently to cause a blurred image. With respect to this, a duty of the reaction solution to be discharged by the recording head 34*c* is set as described above, and thus, such a blurred image can be prevented from occurring. In this case, for example, an experiment may be performed in advance to change a duty and to visually confirm a printed image, and the duty may be set to an appropriate value determined from results of the experiment.

Furthermore, at least the two recording heads 35 are located between the recording head 34*a* and the recording head 34*c* and between the recording head 34*b* and the recording head 34*c*. In such a configuration, the reaction solution can be added by the recording head 34*c* at timing (time T14 and time T24) when certain time has passed after the discharge of the reaction solution by each of the recording heads 34*a* and 34*b*, and when an amount of the reaction solution remaining on the surface of the sheet S is reduced.

Furthermore, the number of the recording heads 35*c* and 35*d* located upstream in the outward direction Dv1 of the recording head 34*c* is equal to or less than the number of the recording heads 35*a* and 35*b* located downstream in the outward direction Dv1 of the recording head 34*c* (the number of the recording heads 35*c* and 35*d* and the number of the recording heads 35*a* and 35*b* are identical to each other in the example). In such a configuration, in the outward printing operation, the reaction solution can be added by the recording head 34*c* at timing (time T14) when certain time has passed after the discharge of the reaction solution by the recording heads 34*a*, and when an amount of the reaction solution remaining on the surface of the sheet S is reduced.

Similarly, the number of the recording heads 35*b* and 35*a* located upstream in the return direction Dv2 of the recording head 34*c* is equal to or less than the number of the recording heads 35*d* and 35*c* located downstream in the return direction Dv2 of the recording head 34*c*. In such a configuration, in the return printing operation, the reaction solution can be added by the recording head 34*c* at timing (time T24) when certain time has passed after the discharge of the reaction solution by the recording heads 34*b*, and when an amount of the reaction solution remaining on the surface of the sheet S is reduced.

FIGS. 8, 9, 10, and 11 are views each schematically illustrating an operation executed in a printing process according to a second exemplary embodiment. As with the first exemplary embodiment, in the second exemplary embodiment, a plurality of recording heads 35 discharge ink of different colors, and recording heads 34 discharge reaction solutions. However, the second exemplary embodiment is different from the first exemplary embodiment in that the recording heads 35 for ink are provided corresponding to six colors (for example, cyan, magenta, yellow, black, red, and green), and the four recording heads 34 for reaction solution are provided. Thus, here, the differences from the first exemplary embodiment will be described mainly, and configurations in common with the first exemplary embodiment are denoted by corresponding reference signs to omit description of the common configurations as appropriate. However, as a matter of course, similar effects are achieved by incorporating the common configurations. Furthermore, in FIGS. 8 to 11, four recording heads 34*a* to 34*d* are illustrated to distinguish the four recording heads 34 for reaction solution, and recording heads 35*a* to 35*f* are illustrated to distinguish the six recording heads 35 for ink.

Figure 10:
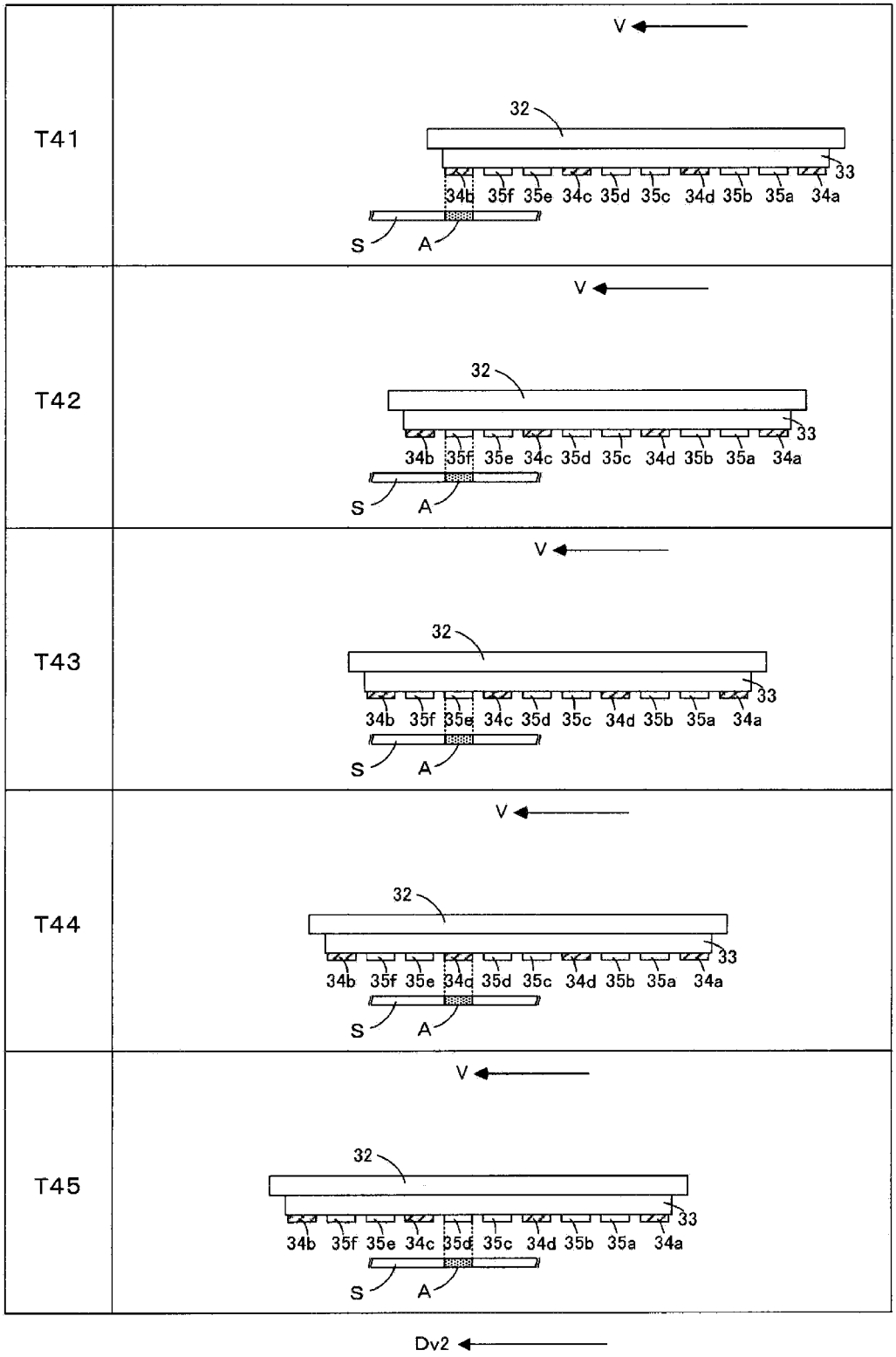
FIG. 10 is a view illustrating an operation executed in the printing process according to the second exemplary embodiment.
Figure 11:
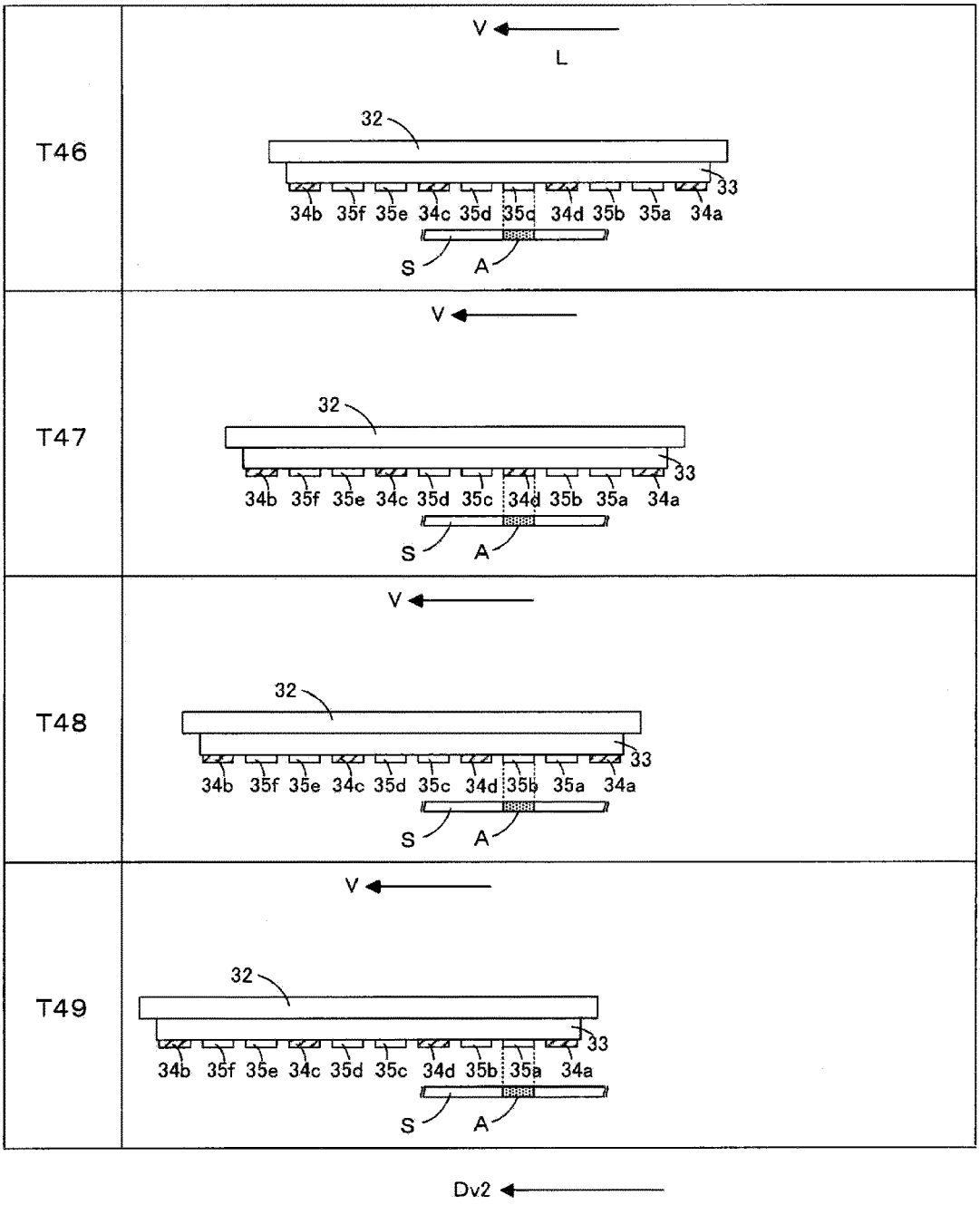
FIG. 11 is a view illustrating an operation executed in the printing process according to the second exemplary embodiment.

As described above, in the printing process, a recording unit 31 moves back and forth in an X-axis direction (main scanning direction) to execute main scanning in each of an outward path and a return path. With respect to this, FIGS. 8 and 9 illustrate an outward printing operation of causing the recording unit 31 to move in an outward direction Dv1 at a speed V and to execute the main scanning, and FIGS. 10 and 11 illustrate a return printing operation of causing the recording unit 31 to move in a return direction Dv2 opposite to the outward direction Dv1 at the speed V and to execute the main scanning.

Figure 8:
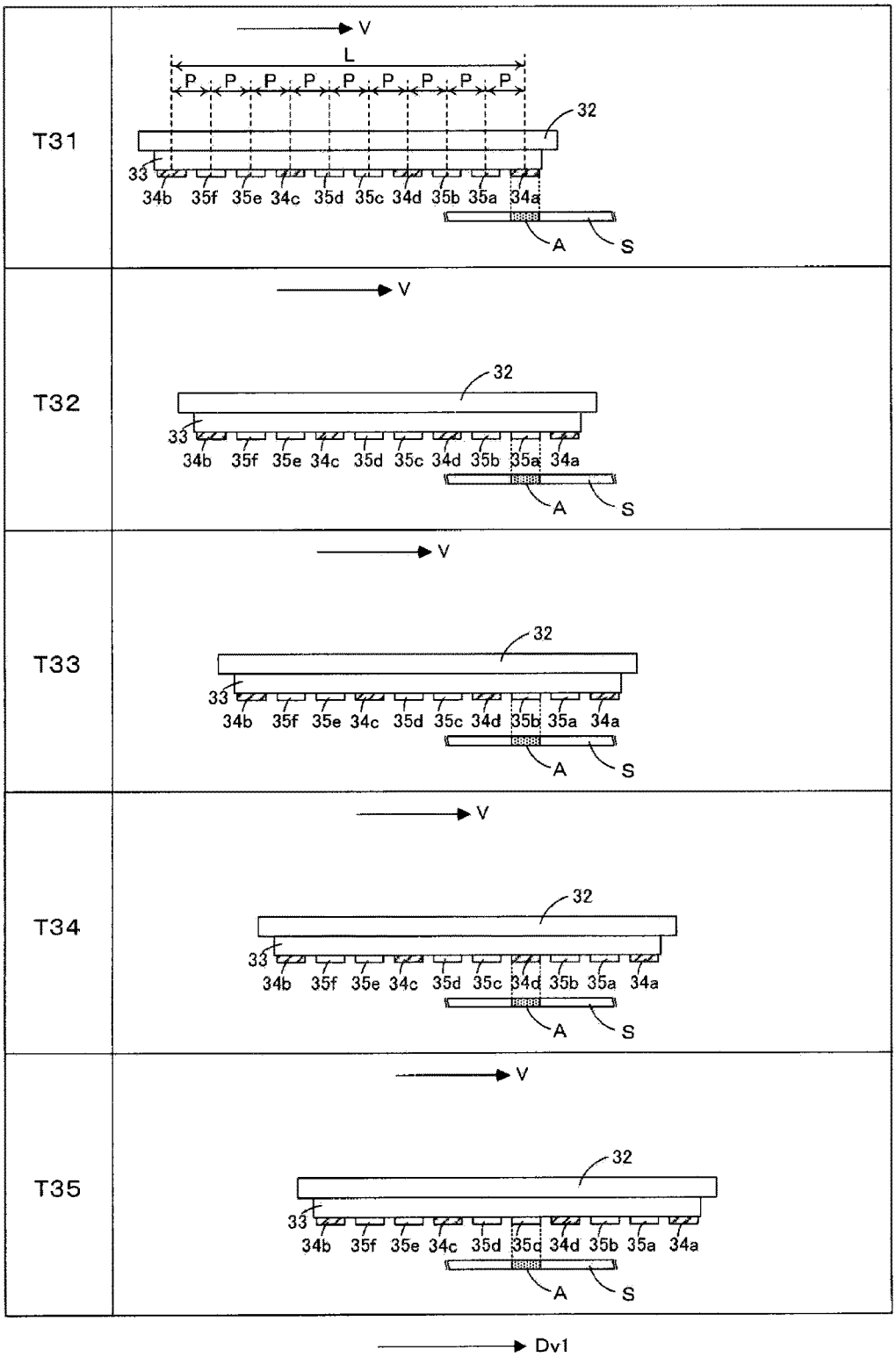
FIG. 8 is a view illustrating an operation executed in a printing process according to a second exemplary embodiment.
Figure 9:
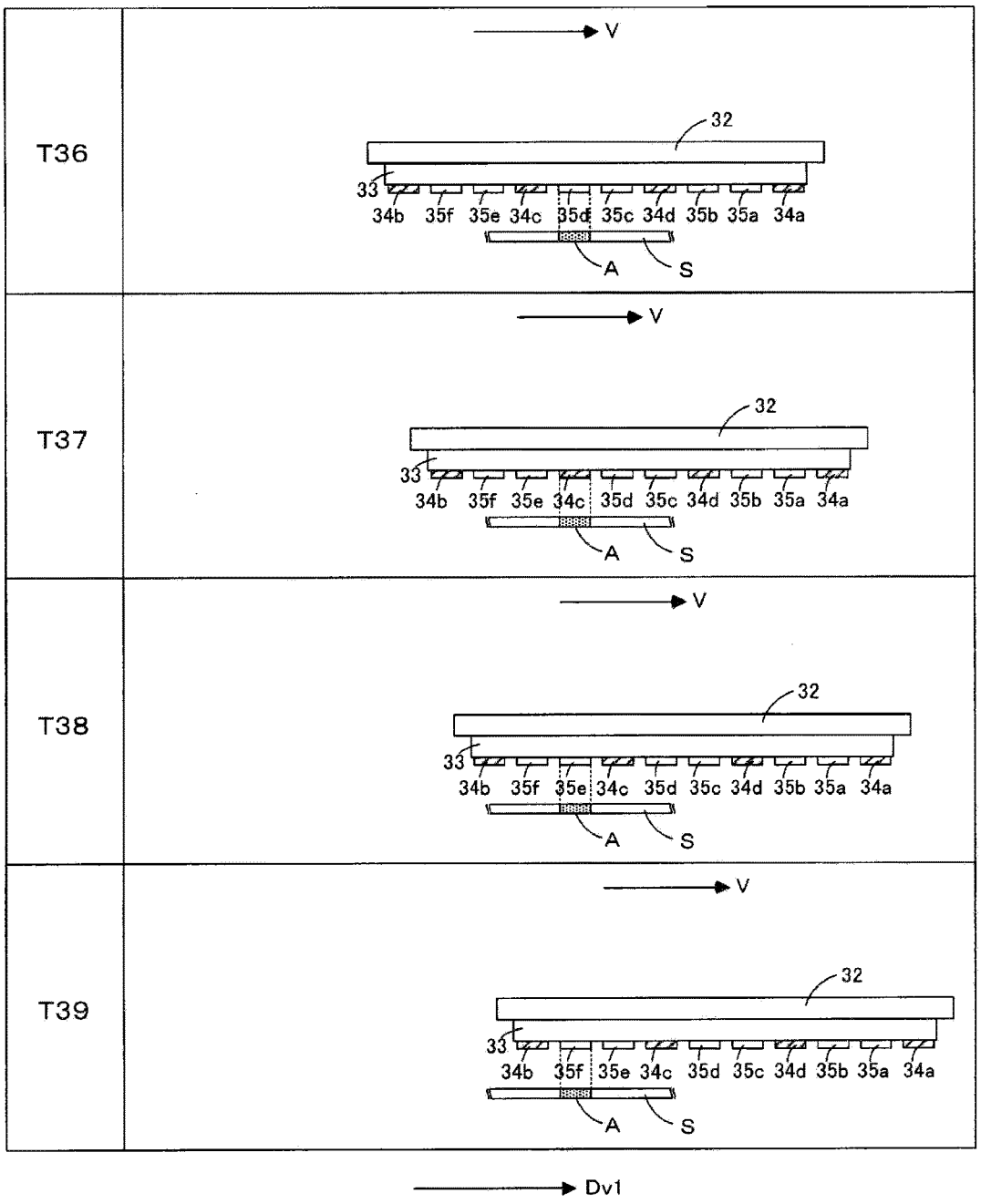
FIG. 9 is a view illustrating an operation executed in the printing process according to the second exemplary embodiment.

As illustrated in FIGS. 8 and 9, the recording heads 34*a*, 34*d*, 34*c*, and 34*b* are arranged in this order from downstream in the outward direction Dv1. Then, between the two recording heads 34*a* and 34*d*, the two recording heads 35*a* and 35*b* are arranged in this order from downstream in the outward direction Dv1. Between the two recording heads 34*d* and 34*c*, the two recording heads 35*c* and 35*d* are arranged in this order from downstream in the outward direction Dv1. Between the two recording heads 34*c* and 34*b*, the two recording heads 35*e* and 35*f* are arranged in this order from downstream in the outward direction Dv1. Accordingly, the recording heads 34*a*, 35*a*, 35*b*, 34*d*, 35*c*, 35*d*, 34*c*, 35*e*, 35*f*, and 34*b* are arranged in this order from downstream in the outward direction Dv1 at an equal pitch P along the outward direction Dv1. Then, in the outward printing operation, each of the recording heads 35*a* to 35*f* discharge the ink, while the recording head 34*a* disposed downstream in the outward direction Dv1 of the recording head 35*a* located most downstream of the recording heads 35*a* to 35*f*, the recording head 34*d* disposed between the two recording heads 35*b* and 35*c* adjacent to each other, and the recording head 34*c* disposed between the two recording heads 35*d* and 35*e* adjacent to each other discharge the reaction solutions.

In particular, here, an example where the reaction solutions and the ink are discharged in a specific range A of a sheet S will be described. At time T31, the recording head 34*a* at a top (most downstream) in the outward direction Dv1 reaches immediately above the range A, and discharges the reaction solution in the range A. Subsequently, the two recording heads 35*a* and 35*b* of the recording heads 35*a* to 35*f* disposed between the two recording heads 34*a* and 34*d* reach in this order immediately above the range A, and each discharge the ink in the range A (time T32 and T33). Accordingly, a color material in the ink discharged from each of the recording heads 35*a* and 35*b* condenses with the reaction solution discharged from the recording head 34*a* onto the sheet S.

At time T34, the recording head 34*d* reaches immediately above the range A, and discharges the reaction solution in the range A to supplement the reaction solution on a surface of the sheet S. Note that a duty of the reaction solution to be discharged by the recording head 34*d* at time T34 is lower than a duty of the reaction solution to be discharged by the recording head 34*a* at time T31. Subsequently, the two recording heads 35*c* and 35*d* of the recording heads 35*a* to 35*f* disposed between the two recording heads 34*d* and 34*c* reach in this order immediately above the range A, and each discharge the ink in the range A (time T35 and T36). Accordingly, a color material in the ink discharged from each of the recording heads 35*c* and 35*d* condenses with the reaction solution discharged from each of the recording heads 34*a* and 34*d* onto the sheet S.

At time T37, the recording head 34*c* reaches immediately above the range A, and discharges the reaction solution in the range A to supplement the reaction solution on the surface of the sheet S. Note that a duty of the reaction solution to be discharged by the recording head 34*c* at time T37 is lower than a duty of the reaction solution to be discharged by the recording head 34*d* at time T34. Subsequently, the two recording heads 35*e* and 35*f* of the recording heads 35*a* to 35*f* disposed between the two recording heads 34*c* and 34*b* reach in this order immediately above the range A, and each discharge the ink in the range A (time T38 and T39). Accordingly, a color material in the ink discharged from each of the recording heads 35*e* and 35*f* condenses with the reaction solution discharged from each of the recording heads 34*a*, 34*d*, and 34*c* onto the sheet S.

Accordingly, the outward printing operation is completed, and the return printing operation is subsequently executed in a similar manner. That is, as illustrated in FIGS. 10 and 11, the recording heads 34*b*, 35*f*, 35*e*, 34*c*, 35*d*, 35*c*, 34*d*, 35*b*, 35*a*, and 34*a* are arranged in this order from downstream in the return direction Dv2 at the equal pitch P along the return direction Dv2. Then, in the return printing operation, each of the recording heads 35*f* to 35*a* discharge the ink, while the recording head 34*b* disposed downstream in the return direction Dv2 of the recording head 35*f* located most downstream of the recording heads 35*f* to 35*a*, the recording head 34*c* disposed between the two recording heads 35*e* and 35*d* adjacent to each other, and the recording head 34*d* disposed between the two recording heads 35*c* and 35*b* adjacent to each other discharge the reaction solutions.

That is, at time T41, the recording head 34*b* located at a top (most downstream) in the return direction Dv2 reaches immediately above the range A, and discharges the reaction solution in the range A. Subsequently, the two recording heads 35*f* and 35*e* of the recording heads 35*f* to 35*a* disposed between the two recording heads 34*b* and 34*c* reach in this order immediately above the range A, and each discharge the ink in the range A (time T42 and T43). Accordingly, a color material in the ink discharged from each of the recording heads 35*f* and 35*e* condenses with the reaction solution discharged from the recording head 34*b* onto the sheet S.

At time T44, the recording head 34*c* reaches immediately above the range A, and discharges the reaction solution in the range A to supplement the reaction solution on the surface of the sheet S. Note that a duty of the reaction solution to be discharged by the recording head 34*c* at time T44 is lower than a duty of the reaction solution to be discharged by the recording head 34*b* at time T41. Subsequently, the two recording heads 35*d* and 35*c* of the recording heads 35*f* to 35*a* disposed between the two recording heads 34*c* and 34*d* reach in this order immediately above the range A, and each discharge the ink in the range A (time T45 and T46). Accordingly, a color material in the ink discharged from each of the recording heads 35*d* and 35*c* condenses with the reaction solution discharged from each of the recording heads 34*b* and 34*c* onto the sheet S.

At time T47, the recording head 34*d* reaches immediately above the range A, and discharges the reaction solution in the range A to supplement the reaction solution on the surface of the sheet S. Note that a duty of the reaction solution to be discharged by the recording head 34*d* at time T47 is lower than a duty of the reaction solution to be discharged by the recording head 34*c* at time T44. Subsequently, the two recording heads 35*b* and 35*a* of the recording heads 35*f* to 35*a* disposed between the two recording heads 34*d* and 34*a* reach in this order immediately above the range A, and each discharge the ink in the range A (time T48 and T49). Accordingly, a color material in the ink discharged from each of the recording heads 35*b* and 35*a* condenses with the reaction solution discharged from each of the recording heads 34*b*, 34*c*, and 34*d* onto the sheet S.

As described above, in the exemplary embodiment, the six recording heads 35*a* to 35*f*, and the three recording heads 34*a*, 34*d*, and 34*c* move in the outward direction Dv1 relative to the sheet S, and discharge the ink and the reaction solutions, respectively onto the sheet S (outward printing operation). In this case, the six recording heads 35*a* to 35*f* are arranged in the outward direction Dv1, and the recording head 34*a* is located downstream in the outward direction Dv1 of the recording heads 35*a* to 35*f*. Therefore, in the outward printing operation, the plurality of recording heads 35*a* to 35*f* sequentially discharge the ink in the range A of the reaction solution discharged by the recording head 34*a* located at the top in the outward direction Dv1. Then, in the exemplary embodiment, to address a reduction in a remaining amount of the reaction solution on the surface of the sheet S during execution of the outward printing operation, the recording head 34*d* is provided between the two recording heads 35*b* and 35*c* adjacent to each other, and the recording head 34*c* is provided between the two recording heads 35*d* and 35*e* adjacent to each other. Accordingly, after the recording head 34*a* has discharged the reaction solution, the recording heads 34*d* and 34*c* can additionally discharge the reaction solutions onto the sheet S to supplement an amount of the reaction solution on the surface of the sheet S. As a result, the amount of the reaction solution on the surface of the sheet S can be prevented from being deficient when each of the recording heads 35*a* to 35*f* discharge the ink.

Furthermore, the recording head 34*b* is disposed downstream in the return direction Dv2 of the six recording heads 35*a* to 35*f*. Then, the six recording heads 35*f* to 35*a*, and the three recording heads 34*b*, 34*c*, and 34*d* move in the return direction Dv2 relative to the sheet S, and discharge the ink and the reaction solutions, respectively onto the sheet S (return printing operation). In such a configuration, in the return printing operation, the six recording heads 35*f* to 35*a* sequentially discharge the ink in the range A of the reaction solution discharged by the recording head 34*b* located at the top in return direction Dv2. In this case, the recording heads 34*c* and 34*d* are provided, and thus, a reduction in a remaining amount of the reaction solution on the surface of the sheet S during execution of the return printing operation can be addressed. That is, after the recording head 34*b* has discharged the reaction solution, the recording heads 34*c* and 34*d* can additionally discharge the reaction solutions onto the sheet S to supplement an amount of the reaction solution on the surface of the sheet S. As a result, the amount of the reaction solution on the surface of the sheet S can be prevented from being deficient when each of the recording heads 35*f* to 35*a* discharge the ink.

That is, between the recording heads 34*a* and 34*b* for reaction solution located at both ends, the recording heads 34*c* and 34*d* for reaction solution are further provided, and the recording heads 34*c* and 34*d* discharge the reaction solutions in each of the outward printing operation and the return printing operation. Accordingly, the amount of the reaction solution on the surface of the sheet S can be prevented further securely from being deficient when each of the recording heads 35*a* to 35*f* discharge the ink.

Furthermore, in the outward printing operation, an amount of the reaction solution to be discharged per unit area by the recording head 34*d* onto the sheet S is smaller than an amount of the reaction solution to be discharged per unit area by the recording head 34*a* onto the sheet S, and an amount of the reaction solution to be discharged per unit area by the recording head 34*c* onto the sheet S is smaller than the amount of the reaction solution to be discharged per unit area by the recording heads 34*d* onto the sheet S. Furthermore, in the return printing operation, an amount of the reaction solution to be discharged per unit area by the recording head 34*c* onto the sheet S is smaller than an amount of the reaction solution to be discharged per unit area by the recording head 34*b* onto the sheet S, and an amount of the reaction solution to be discharged per unit area by the recording head 34*d* onto the sheet S is smaller than the amount of the reaction solution to be discharged per unit area by the recording head 34*c* onto the sheet S. Accordingly, even when the recording heads 34*c* and 34*d* add the reaction solutions in each of the outward printing operation and the return printing operation, an excess of the reaction solution on the surface of the sheet S can be prevented.

Furthermore, the amount of the reaction solution to be discharged per unit area by the recording head 34*c* onto the sheet S in the outward printing operation is smaller than the amount of the reaction solution to be discharged per unit area by the recording head 34*c* onto the sheet S in the return printing operation, and the amount of the reaction solution to be discharged per unit area by the recording head 34*d* onto the sheet S in the return printing operation is smaller than the amount of the reaction solution to be discharged per unit area by the recording head 34*d* onto the sheet S in the outward printing operation. Accordingly, even when the recording heads 34*c* and 34*d* add the reaction solutions in each of the outward printing operation and the return printing operation, an excess of the reaction solution on the surface of the sheet S can be prevented.

As described above, in the above-described exemplary embodiment, the printer 300 corresponds to an example of the "printing apparatus" according to the present invention. The recording unit 31 corresponds to an example of the "recording section" according to the present invention. The X-axis motor Mx corresponds to an example of the "driving section" according to the present invention. The printer controller 400 corresponds to an example of the "controller" according to the present invention. The sheet S corresponds to an example of the "recording medium" according to the present invention. The outward direction Dv1 corresponds to an example of the "first direction" according to the present invention. The return direction Dv2 corresponds to an example of the "second direction" according to the present invention. The outward printing operation corresponds to an example of the "first operation" according to the present invention. The return printing operation corresponds to an example of the "second operation" according to the present invention. In the first exemplary embodiment, the recording heads 35*a* to 35*d* respectively correspond to examples of the "ink heads" according to the present invention. The recording head 34*a* corresponds to an example of the "first reaction solution head" according to the present invention. The recording head 34*c* corresponds to an example of the "second reaction solution head" according to the present invention. The recording head 34*b* corresponds to an example of the "third reaction solution head" according to the present invention. Furthermore, in the second exemplary embodiment, the recording heads 35*a* to 35*f* respectively correspond to examples of the "ink heads" according to the present invention. The recording head 34*a* corresponds to an example of the "first reaction solution head" according to the present invention. The recording head 34*c* corresponds to an example of the "second reaction solution head" according to the present invention. The recording head 35*b* corresponds to an example of the "third reaction solution head" according to the present invention. The recording head 34*d* corresponds to an example of the "fourth reaction solution head" according to the present invention.

Note that the present invention is not limited to the above-described exemplary embodiments, and various modifications can be made to the above-described exemplary embodiments without departing from the spirit and gist of the present invention. For example, the specific configuration of the recording unit 31 may be appropriately modified. Therefore, the number of the recording heads 35 is not limited to "four" or "six" as described above, but can be modified. The number of and the arrangement positions of the recording heads 34 may be modified as appropriate.

Figure 12:
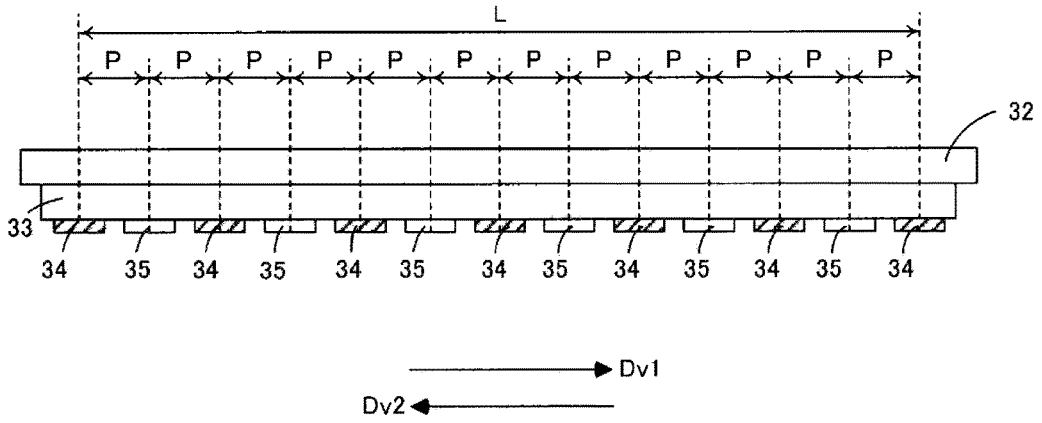
FIG. 12 is a view schematically illustrating a first modified example of a recording unit.

FIG. 12 is a view schematically illustrating a first modified example of a recording unit. In the modified example in FIG. 12, recording heads 34 for reaction solution and recording heads 35 for ink are alternately arranged in an X-axis direction one by one with the recording heads 34 being located at both ends. Then, in an outward printing operation, each of the recording heads 35 discharge ink, and each of the recording heads 34 other than a recording head 34 located most upstream in an outward direction Dv1 discharges a reaction solution. In this case, the recording heads 34 located more upstream in the outward direction Dv1 discharge the reaction solutions at a lower duty. Furthermore, in a return printing operation, each of the recording heads 35 discharge the ink, and each of the recording heads 34 other than a recording head 34 located most upstream in a return direction Dv2 discharges the reaction solution. In this case, the recording heads 34 located more upstream in the return direction Dv2 discharge the reaction solutions at a lower duty.

Alternatively, in the modified example in FIG. 12, each of the recording heads 34 may discharge the reaction solution at an identical duty. In this case, in the outward printing operation, each of the recording heads 34 may discharge the reaction solution in an amount causing condensation of a color material in the ink to be discharged by each of the recording heads 35 adjacent to the recording heads 34 upstream in the outward direction Dv1. In the return printing operation, each of the recording heads 34 may discharge the reaction solution in an amount causing condensation of a color material in the ink to be discharged by each of the recording heads 35 adjacent to the recording heads 34 upstream in the return direction Dv2.

Figure 13:
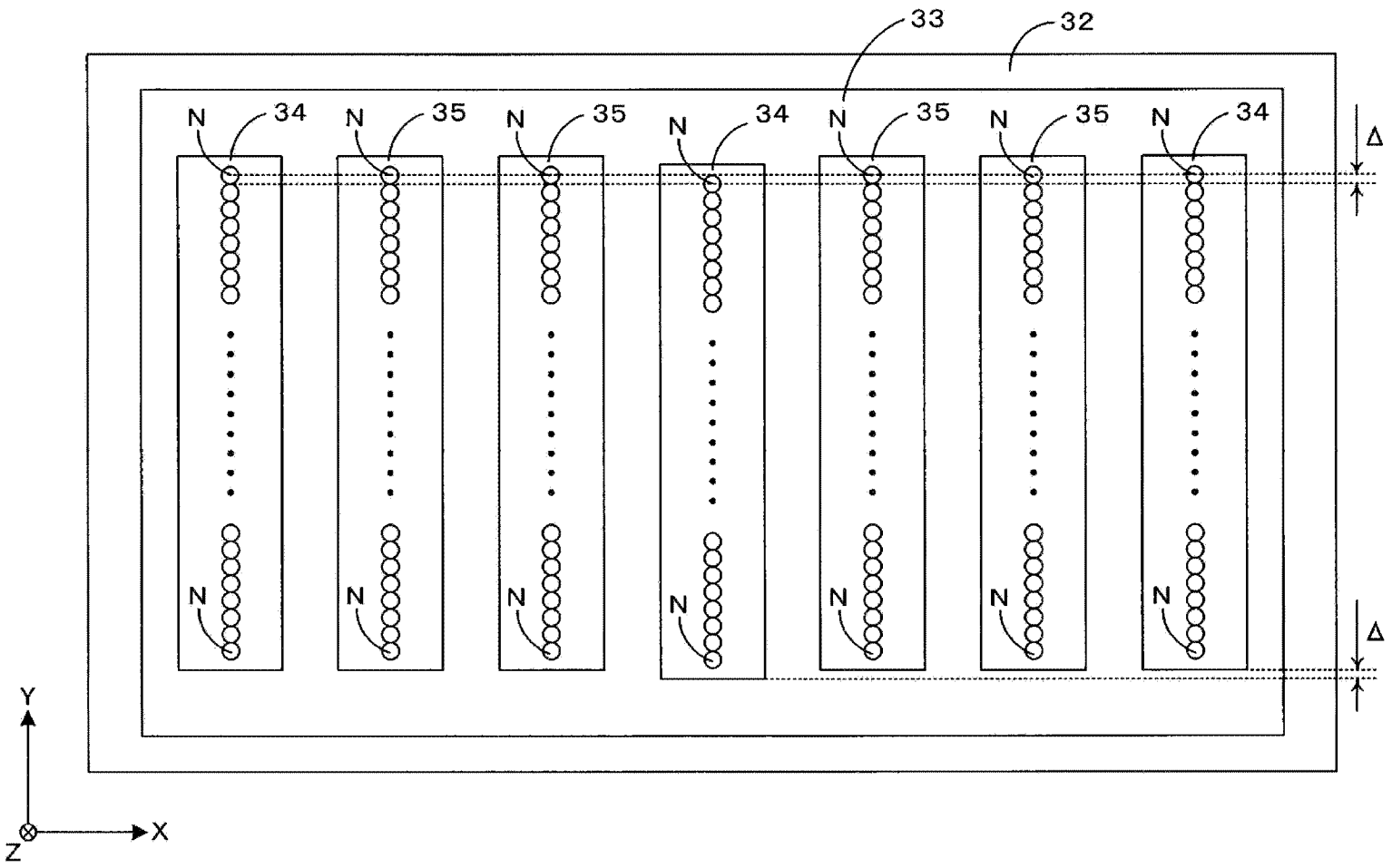
FIG. 13 is a bottom view partially illustrating a second modified example of a recording unit.

FIG. 13 is a bottom view partially illustrating a second modified example of a recording unit. In the modified example in FIG. 13, a recording head 34 located at the center is deviated in a Y-axis direction by a deviation amount Δ with respect to recording heads 34 located at both ends in an X-axis direction. Therefore, a landing position of a reaction solution discharged from the recording head 34 located at the center onto a sheet S deviates in the Y-axis direction (third direction) by the deviation amount Δ with respect to landing positions of the reaction solutions discharged from the recording heads 34 located at both the ends onto the sheet S. In such a configuration, the reaction solution can be discharged relatively evenly onto a surface of the sheet S.

In this case, the deviation amount Δ may be set to a half of a pitch at which nozzles N of each of the recording heads 34 are arranged in the Y-axis direction. Accordingly, a droplet discharged from the recording head 34 located at the center can be caused to land in a plurality of droplets discharged from the recording heads 34 located at both the ends and arranged in the Y-axis direction on the surface of the sheet S, and the reaction solution can be discharged further evenly.

Note that the landing position of the reaction solution discharged by the recording head 34 located at the center and the landing positions of the reaction solutions discharged by the recording heads 34 located at both the ends may be caused to deviate in the X-axis direction, instead of the Y-axis direction. Specifically, a head controller 420 controls timing of the discharge of the reaction solution by the recording head 34 located at the center and timing of the discharge of the reaction solutions by the recording heads 34 located at both the ends to cause the landing positions of the reaction solutions discharged by the respective recording heads 34 to differ from each other in the X-axis direction. Accordingly, the reaction solution can be discharged relatively evenly onto the sheet S.

For example, in the configuration described in the first exemplary embodiment, the position of the recording head 34*c* may be changed to a position between the two recording heads 35*c* and 35*d*. In such a modified example, the number of the recording heads 35*d* located upstream in the outward direction Dv1 of the recording head 34*c* is less than the number of the recording heads 35*a*, 35*b*, and 35*c* located downstream in the outward direction Dv1 of the recording head 34*c*. Therefore, in the outward printing operation, the reaction solution can be added by the recording head 34*c* at timing when certain time has passed after the discharge of the reaction solution by the recording head 34*a*, and when an amount of the reaction solution remaining on the surface of the sheet S is reduced.

Furthermore, in the above-described exemplary embodiment, each of the recording heads 34*a* and 34*b*, and the recording head 34*c* are assumed to discharge the reaction solution having identical composition. However, composition of the reaction solution to be discharged by the recording heads 34*a* and 34*b* may differ from composition of the reaction solution to be discharged by the recording head 34*c*. The composition of the reaction solution will be described below in the configuration of the first exemplary embodiment as an example.

Specifically, for example, a molar concentration of a metal ion in the reaction solution may be varied. In the first exemplary embodiment as an example, each of the recording heads 34*a* and 34*b* may discharge the reaction solution containing calcium nitrate in an amount of 0.81 mol/L, and the recording head 34*c* may discharge the reaction solution containing calcium nitrate in an amount of 0.4 mol/L. In this case, since an amount of a color material (pigment molecular) capable of condensing is proportional to a molar concentration of a metal ion, a greater amount of the color material condenses with the reaction solution discharged from each of the recording heads 34*a* and 34*b*.

Alternatively, a type of the metal ion in the reaction solution may be varied. That is, each of the recording heads 34*a* and 34*b* may discharge the reaction solution containing calcium nitrate in an amount of 0.81 mol/L, and the recording head 34*c* may discharge the reaction solution containing magnesium nitrate in an amount of 0.81 mol/L. In this case, since reactivity of a color material containing calcium nitrate is higher than reactivity of a color material containing magnesium nitrate, a greater amount of the color material condenses with the reaction solution discharged from each of the recording heads 34*a* and 34*b*.

Furthermore, as compared with the reaction solution to be discharged by the recording head 34*a*, the reaction solution to be discharged by the recording head 34*c* may have composition appropriate for the ink to be discharged from each of the recording heads 35*c* and 35*d*. In this case, the composition appropriate for the ink refers to composition having higher reactivity to a color material in the ink, in other words, composition enabling a greater amount of the color material to condense. Specifically, an experiment of causing a color material in the ink discharged from each of the recording heads 35*c* and 35*d* to condense with a plurality of reaction solutions having different compositions can be performed to determine the composition appropriate for the ink in advance from the results of the experiment. In such a configuration, in the outward printing operation, after the recording head 34*c* has discharged the reaction solution, the color material in the ink discharged from each of the recording heads 35*c* and 35*d* can be fixed securely onto the sheet S.

Note that these modifications relating to the composition of the reaction solution can also be applied to the configuration of the second exemplary embodiment. Furthermore, when these modifications are applied to the configuration of the first or second exemplary embodiment, the printer 300 may be configured to execute the outward printing operation alone. In this case, the recording head 34*b* may not be provided.

Furthermore, in the configuration of executing the outward printing operation alone, disposition of the recording heads 34*a* and 34*c* and composition of the reaction solution to be discharged from each of the recording heads 34*a* and 34*c* may be configured as described below, for example. That is, in the configuration of the first exemplary embodiment, the recording head 34*a* discharges the reaction solution containing calcium nitrate in an amount of 0.81 mol/L, and the recording head 34*c* discharges the reaction solution containing calcium nitrate in an amount of 0.4 mol/L, and further, disposition of the recording head 34*c* is modified to dispose the recording head 34*c* between the recording heads 35*c* and 35*d*. Then, considering that non-uniformity of a plain color of yellow is less noticeable, the recording heads 35*a*, 35*b*, and 35*c* may be configured to discharge black ink, cyan ink, and magenta ink, respectively, and the recording head 35*d* may be configured to discharge yellow ink. In such a configuration, in the outward printing operation, color materials in the black ink, the cyan ink, and the magenta ink mainly condense with the reaction solution containing calcium nitrate at a high concentration, and a color material in the yellow ink mainly condenses with the reaction solution containing calcium nitrate at a low concentration.

Furthermore, colors of the ink to be discharged from the plurality of recording heads 34 can be modified as appropriate. Thus, a recording head 35 located upstream in the outward direction Dv1 of the recording head 34*c* may discharge black ink. In such a configuration, the black ink is discharged onto the sheet S supplemented with the reaction solution by the recording head 34*c*, and thus, a black color material can be fixed securely onto the sheet S. Note that when the modified example is applied to the configuration of the first or second exemplary embodiment, the printer 300 may be configured to execute the outward printing operation alone.

Furthermore, in the above-described exemplary embodiments, while the sheet S is stationary, the recording heads 34 and the recording heads 35 are caused to move at the movement speed V. However, as described, for example in JP-A-2015-134460, the printer 300 can also include a configuration where heads configured to discharge reaction solutions and heads configured to discharge ink are fixed, and a recording medium is transported.

REFERENCE SIGNS LIST

300 . . . Printer, 31 . . . Recording unit, 32 . . . Carriage, 33 . . . Support plate, 34, 34*a* to 34*d* . . . Recording head (for reaction solution), 35, 35*a* to 35*f* . . . Recording head (for ink), 400 . . . Printer controller, Mx . . . X-axis motor, S . . . Sheet, Dv1 . . . Outward direction, Dv2 . . . Return direction, X . . . X-axis direction, Y . . . Y-axis direction, Z . . . Z-axis direction, N . . . Nozzle The entire disclosure of Japanese Patent Application No. 2016-045292, filed Mar. 9, 2016 is expressly incorporated by reference herein.

The invention claimed is:

1. A printing apparatus comprising:

a recording section including:

a plurality of ink heads configured to discharge, onto a recording medium, ink containing a color material condensing with a reaction solution;

a first reaction solution head configured to discharge the reaction solution onto the recording medium; and a second reaction solution head configured to discharge the reaction solution onto the recording medium;

a driving section configured to drive the recording section relative to the recording medium; and a controller configured to execute a first operation of:

causing the driving section to move the recording section in a first direction relative to the recording medium;

causing the plurality of ink heads to discharge the ink; and causing the first reaction solution head and the second reaction solution head to discharge the reaction solutions, wherein the plurality of ink heads are arranged in the first direction, the first reaction solution head is located downstream in the first direction of an ink head of the plurality of ink heads located most downstream in the first direction, and the second reaction solution head is located between two ink heads of the plurality of ink heads located adjacent to each other in the first direction.

2. The printing apparatus according to claim 1, wherein, in the first operation, an amount of the reaction solution to be discharged per unit area by the second reaction solution head onto the recording medium is smaller than an amount of the reaction solution to be discharged per unit area by the first reaction solution head onto the recording medium.

3. The printing apparatus according to claim 1, wherein at least two ink heads of the plurality of ink heads are located between the first reaction solution head and the second reaction solution head.

4. The printing apparatus according to claim 1, wherein the number of the ink heads located upstream in the first direction of the second reaction solution head is equal to or less than the number of the ink heads located downstream in the first direction of the second reaction solution head.

5. The printing apparatus according to claim 1, wherein an ink head of the plurality of ink heads configured to discharge black ink is located upstream in the first direction of the second reaction solution head.

6. The printing apparatus according to claim 1, wherein as compared with the reaction solution to be discharged by the first reaction solution head, the second reaction solution head discharges the reaction solution appropriate for ink to be discharged by an ink head of the plurality of ink heads located upstream in the first direction of the second reaction solution head.

7. The printing apparatus according to claim 1, wherein the recording section includes a third reaction solution head being located downstream in a second direction opposite to the first direction of an ink head of the plurality of ink heads located most downstream in the second direction, and being configured to discharge the reaction solution onto the recording medium, and the controller is configured to execute a second operation of causing the driving section to move the recording section in the second direction relative to the recording medium, causing the plurality of ink heads to discharge the ink, and causing the third reaction solution head and the second reaction solution head to discharge the reaction solutions.

8. The printing apparatus according to claim 7, wherein the recording section includes a fourth reaction solution head located between two ink heads of the plurality of ink heads located upstream in the second direction of the second reaction solution head, and the controller causes the fourth reaction solution head to discharge the reaction solution in the first operation and the second operation.

9. The printing apparatus according to claim 8, wherein in the first operation, an amount of the reaction solution to be discharged per unit area by the fourth reaction solution head onto the recording medium is smaller than the amount of the reaction solution to be discharged per unit area by the first reaction solution head onto the recording medium, and the amount of the reaction solution to be discharged per unit area by the second reaction solution head onto the recording medium is smaller than the amount of the reaction solution to be discharged per unit area by the fourth reaction solution head onto the recording medium, and in the second operation, an amount of the reaction solution to be discharged per unit area by the second reaction solution head onto the recording medium is smaller than an amount of the reaction solution to be discharged per unit area by the third reaction solution head onto the recording medium, and an amount of the reaction solution to be discharged per unit area by the fourth reaction solution head onto the recording medium is smaller than the amount of the reaction solution to be discharged per unit area by the second reaction solution head onto the recording medium.

10. The printing apparatus according to claim 8, wherein the amount of the reaction solution to be discharged per unit area by the second reaction solution head onto the recording medium in the first operation is smaller than the amount of the reaction solution to be discharged per unit area by the second reaction solution head onto the recording medium in the second operation, and the amount of the reaction solution to be discharged per unit area by the fourth reaction solution head onto the recording medium in the second operation is smaller than the amount of the reaction solution to be discharged per unit area by the fourth reaction solution head onto the recording medium in the first operation.

11. The printing apparatus according to claim 1, wherein a landing position of the reaction solution discharged by the first reaction solution head onto the recording medium differs from a landing position of the reaction solution discharged by the second reaction solution head onto the recording medium.

12. The printing apparatus according to claim 11, wherein the first reaction solution head and the second reaction solution head are deviated from each other in a third direction intersecting the first direction, and a landing position of the reaction solution discharged by the first reaction solution head onto the recording medium differs in the third direction from a landing position of the reaction solution discharged by the second reaction solution head onto the recording medium.

13. The printing apparatus according to claim 11, wherein the controller controls timing when the first reaction solution head discharges the reaction solution and timing when the second reaction solution head discharges the reaction solution to cause the landing position of the reaction solution discharged by the first reaction solution head onto the recording medium to differ in the first direction from the landing position of the reaction solution discharged by the second reaction solution head onto the recording medium.

* * * * *